US006872017B2

(12) United States Patent
Kato

(10) Patent No.: US 6,872,017 B2
(45) Date of Patent: Mar. 29, 2005

(54) IMAGE-FORMING DEVICE

(75) Inventor: Tetsuya Kato, Chiryu (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 10/725,445

(22) Filed: Dec. 3, 2003

(65) Prior Publication Data

US 2004/0141782 A1 Jul. 22, 2004

(51) Int. Cl.[7] ..... B41J 11/44

(52) U.S. Cl. ..... 400/283; 400/61; 400/70; 400/74; 400/76; 347/248

(58) Field of Search ..... 400/283, 61, 70, 400/74, 76; 347/248

(56) References Cited

U.S. PATENT DOCUMENTS 5,255,987 A * 10/1993 Mizuno et al. ..... 400/61
6,039,481 A * 3/2000 Ham ..... 400/708
6,152,626 A * 11/2000 Yanagi et al. ..... 400/279
6,305,856 B1 * 10/2001 Miyazaki ..... 400/279
6,367,996 B1 * 4/2002 Edwards ..... 400/582
6,411,324 B1 * 6/2002 Christiansen et al. ..... 347/248
6,547,462 B1 * 4/2003 Yanagi et al. ..... 400/283

FOREIGN PATENT DOCUMENTS

JP 37371 1/1991
JP 3182802 4/2001

* cited by examiner

*Primary Examiner*—Charles H. Nolan, Jr.
(74) *Attorney, Agent, or Firm*—Oliff & Berridge, PLC

(57) ABSTRACT

A printer prints a black mark BM having a left mark edge BMa and a right mark edge BMb on a paper P. An encoder offset SH_L_EDG for the left mark edge BMa is set based on the difference between the carriage position (encoder value PR_ENC_L) that is detected when the print head 10 prints the left mark edge BMa and the carriage position (encoder value SEN_ENC_L) that is detected when the media sensor 68 detects the left mark edge BMa. Similarly, an encoder offset SH_R_EDG for the right mark edge BMb is set based on the difference between the carriage position (encoder value PR_ENC_R) that is detected when the print head 10 prints the right mark edge BMb and the carriage position (encoder value SEN_ENC_R) that is detected when the media sensor 68 detects the right mark edge BMb. In this way, the printer can suppress the effects of mounting error and can prevent a decline in accuracy when detecting edges of the paper P.

14 Claims, 11 Drawing Sheets

IMAGE-FORMING DEVICE

BACKGROUND OF THE INVENTION

1. Field of the Invention

The present invention relates to an image-forming device for forming images on a recording medium.

2. Description of Related Art

Image-forming devices for printing text, graphics, and the like on a recording medium, such as paper, are well known in the art. Such image-forming devices detect the edges of the paper with an optical sensor, and control movement of a print head mounted integrally on a carriage using the edges of the paper as reference positions, while ejecting ink droplets at desired positions on the paper.

Side edges of a recording medium can be detected by detecting the reflectance value while scanning the optical sensor provided on the carriage across the medium in the widthwise direction thereof (left-to-right direction) as proposed by Japanese unexamined patent application publication No. HEI-3-7371. That is, the left edge can be detected as a position at which the reflectance first increases and the right edge as a position at which the reflectance last decreases.

Generally, the optical sensor is provided integrally with the carriage (print head). Therefore, the print head can be moved to desired positions by controlling the print head with consideration for the distance between the optical sensor and the carriage (design value).

However, at times the distance between the optical sensor and the carriage differs from the design value due to mounting errors and the like. Such mounting errors can reduce the precision in detecting edges of the recording paper.

To resolve this problem, U.S. Pat. No. 5,255,987 has proposed an image-forming device that prints a mark at a prescribed position on the paper, that scans the location of the printed mark with an optical sensor, and that calculates an offset based on the difference between the carriage position stored in the image-forming device when printing the mark and the carriage position when the mark is read by the optical sensor.

An image-forming device with this construction can correct mounting errors by obtaining this offset value, which corresponds to the actual distance between the optical sensor and the carriage. Accordingly, the image-forming device can prevent a drop in detection accuracy when detecting the edges of the paper.

SUMMARY OF THE INVENTION

However, the image-forming device proposed by the U.S. Pat. No. 5,255,987 scans the optical sensor for the mark only at one location. Therefore, while the precision in detecting one edge of the recording medium is improved, the precision for detecting the other edge of the paper may not improve.

Specifically, output from some optical sensor changes in a different manner when the sensor moves from a recording paper to a region outside of the recording paper and when moving from a region outside the recording paper to the recording paper. If the sensor used to scan a mark at only one location has such a property, i.e., if the sensor output varies differently according to the manner of change in the detected object, such a sensor can only calculate an offset suited to one of the patterns of change. If a sensor having these properties is used, detection accuracy can be improved for only one edge of the recording paper, but cannot be improved for the other.

In view of the foregoing, it is an object of the present invention to provide an improved image-forming device that is capable of improving the accuracy in detecting both edges of a recording medium and that is capable of preventing a decline in detection accuracy caused by mounting errors in the detecting unit and the carriage.

To attain the above and other objects, the present invention provides an image-forming device comprising: a recording medium conveying unit that conveys a recording medium in a conveying direction, the recording medium having a first medium edge and a second medium edge in a widthwise direction orthogonal to the conveying direction; a carriage having a print head that prints on the recording medium; a detecting unit that performs a detecting operation; a driving unit driving the carriage and the detecting unit to move in the widthwise direction while maintaining fixed a distance between the detecting unit and the carriage in the widthwise direction; a carriage position detecting unit that detects a position of the carriage in the widthwise direction; a mark printing unit that controls the print head to print on the recording medium a calibrating mark, the calibrating mark having a first mark edge and a second mark edge in the widthwise direction, the print head printing the first mark edge when the carriage is located on a first-mark-edge printing carriage position and printing the second mark edge when the carriage is located on a second-mark-edge printing carriage position, the first mark edge corresponding to the first medium edge and the second mark edge corresponding to the second medium edge; a mark-edge-detection control unit that controls the driving unit to move the carriage and the detecting unit in the widthwise direction and controls the detecting unit to detect the first mark edge and the second mark edge, the mark-edge-detection control unit controlling the carriage position detecting unit to detect a position of the carriage when the detecting unit detects the first mark edge and when the detecting unit detects the second mark edge; an offset setting unit that sets a first edge distance offset based on a first difference between the first-mark-edge printing carriage position and a position of the carriage that is detected when the detecting unit detects the first mark edge, and that sets a second edge distance offset based on a second difference between the second-mark-edge printing carriage position and a position of the carriage that is detected when the detecting unit detects the second mark edge; a medium-edge-detection control unit that controls the driving unit to move the carriage and the detecting unit in the widthwise direction and controls the detecting unit to detect the first medium edge and the second medium edge, the medium-edge-detection control unit controlling the carriage position detecting unit to detect a position of the carriage when the detecting unit detects the first medium edge and when the detecting unit detects the second medium edge; an edge position determining unit that determines a first medium edge carriage position based on a position of the carriage detected when the detecting unit detects the first medium edge and the first edge distance offset, and that determines a second medium edge carriage position based on a position of the carriage detected when the detecting unit detects the second medium edge and the second edge distance offset; and a print controlling unit that controls the print head to perform printing operations on the recording medium within a printable area that is defined between the first medium edge carriage position and the second medium edge carriage position, the carriage being located at the first medium edge when the carriage position detecting unit detects that the carriage is located at the first medium edge carriage position, the carriage being located at the second medium edge when the carriage position detecting unit detects that the carriage is located at the second medium edge carriage position.

According to another aspect, the present invention provides an image-forming device comprising: a recording medium conveying unit that conveys a recording medium in a conveying direction; a carriage having a print head that prints on the recording medium and having a detecting unit that performs a detecting operation, the print head and the detecting unit being distant from each other in a widthwise direction orthogonal to the conveying direction; a driving unit driving the carriage to move in the widthwise direction; a carriage position detecting unit that detects a position of the carriage in the widthwise direction; a first recording-medium convey control unit controlling the recording medium conveying unit to convey a first recording-medium in the conveying direction; a mark printing unit that controls the print head to print on the recording medium a calibrating mark, the calibrating mark having a first mark edge and a second mark edge in the widthwise direction, the print head printing the first mark edge when the carriage is located on a first-mark-edge printing carriage position and printing the second mark edge when the carriage is located on a second-mark-edge printing carriage position a mark-edge-detection control unit that controls the driving unit to move the carriage in the widthwise direction and controls the detecting unit to detect the first mark edge and the second mark edge, the detecting unit outputting a first-mark-edge detection result when detecting the first mark edge while moving in the widthwise direction and outputting a second-mark-edge detection result when detecting the second mark edge while moving in the widthwise direction, the mark-edge-detection control unit controlling the carriage position detecting unit to detect a position of the carriage when the detecting unit detects the first mark edge and when the detecting unit detects the second mark edge; an offset setting unit that sets a first edge distance offset based on a first difference between the first-mark-edge printing carriage position and a position of the carriage that is detected when the detecting unit detects the first mark edge, and that sets a second edge distance offset based on a second difference between the second-mark-edge printing carriage position and a position of the carriage that is detected when the detecting unit detects the second mark edge: a second recording-medium convey control unit controlling the recording medium conveying unit to convey a second recording-medium in the conveying direction, the second recording medium having a first medium edge and a second medium edge in the widthwise direction; a medium-edge-detection control unit that controls the driving unit to move the carriage in the widthwise direction and controls the detecting unit to detect the first medium edge and the second medium edge, the detecting unit outputting a detection result that corresponds to the first-mark-edge detection result when detecting the first medium edge while moving in the widthwise direction and outputting a detection result that corresponds to the second-mark-edge detection result when detecting the second medium edge while moving in the widthwise direction, the medium-edge-detection control unit controlling the carriage position detecting unit to detect a position of the carriage when the detecting unit detects the first medium edge and when the detecting unit detects the second medium edge; an edge position determining unit that determines a first medium edge carriage position based on a position of the carriage detected when the detecting unit detects the first medium edge and the first edge distance offset, and that determines a second medium edge carriage position based on a position of the carriage detected when the detecting unit detects the second medium edge and the second edge distance offset; and a print controlling unit that controls the print head to perform printing operations on the second recording medium within a printable area that is defined between the first medium edge carriage position and the second medium edge carriage position, the carriage being located at the first medium edge when the carriage position detecting unit detects that the carriage is located at the first medium edge carriage position, the carriage being located at the second medium edge when the carriage position detecting unit detects that the carriage is located at the second medium edge carriage position.

BRIEF DESCRIPTION OF THE DRAWINGS

In the drawings:

FIG. 1 is a perspective view showing a multifunction device according to a preferred embodiment of the present invention, including a printer function, copier function, scanner function, facsimile function, telephone function, and the like;

FIG. 3(*b*) is a block diagram showing the general construction of a control unit in the multifunction device;

DETAILED DESCRIPTION OF THE PREFERRED EMBODIMENT

Figure 1:
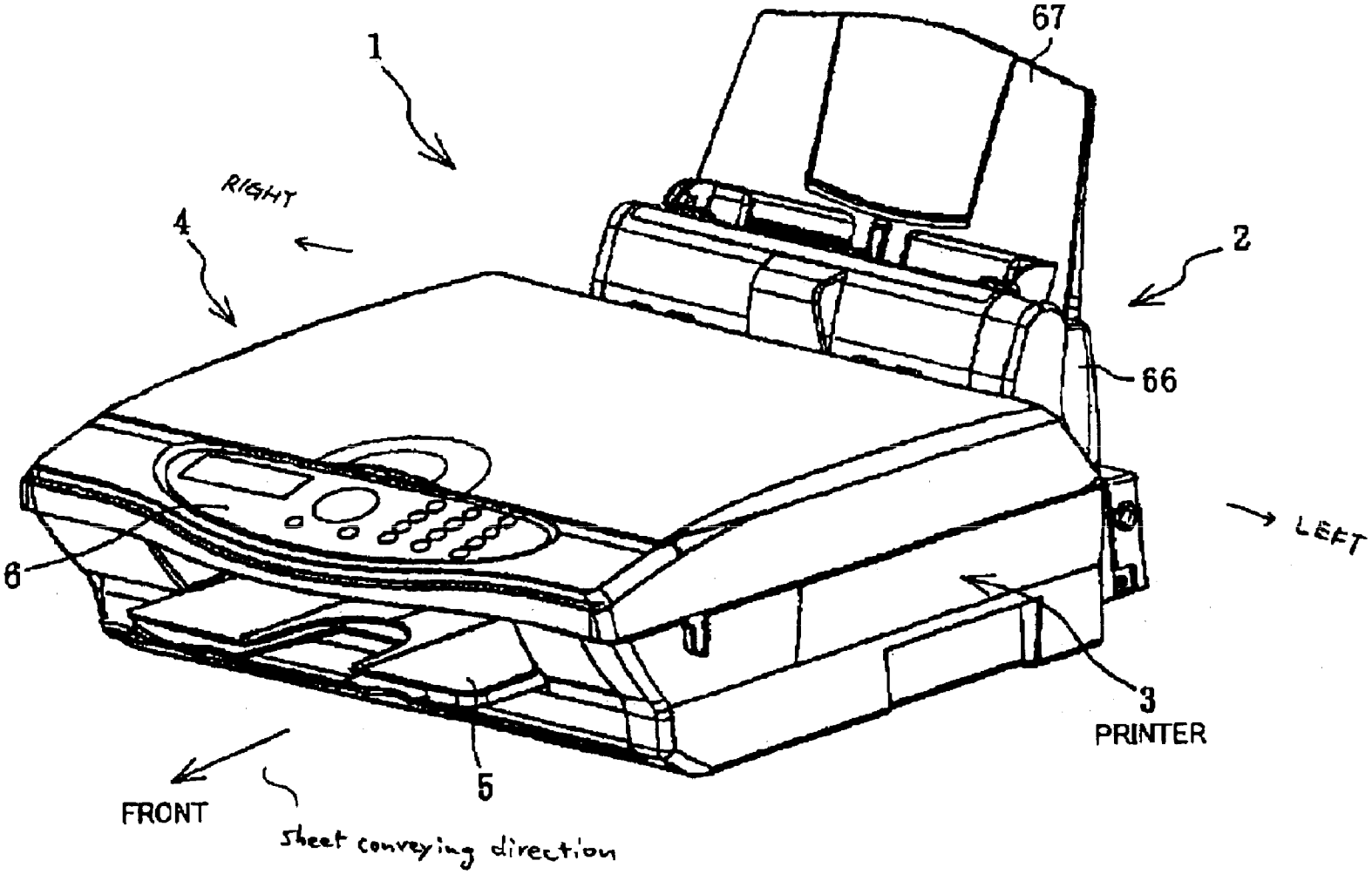

An image forming device according to a preferred embodiment of the present invention will be described while referring to the accompanying drawings wherein like parts and components are designated by the same reference numerals to avoid duplicating description.

FIG. 1 is a perspective view of a multifunction device 1 of the preferred embodiment, to which the present invention is applied. The multifunction device 1 has a printer function, a copier function, a scanner function, a facsimile function, a telephone function, and the like.

As shown in FIG. 1, a paper supplying unit 2 is provided in the rear section of the multifunction device 1. An inkjet printer 3 is provided in front of and below the paper supplying unit 2. A scanning unit 4 for implementing the copier function and facsimile function is provided above the printer 3. A discharge tray 5 is provided on the front side of the printer 3. An operating panel 6 is provided on the top surface on the front end of the scanning unit 4.

The paper supplying unit 2 includes a sloped wall section 66 for maintaining paper in a sloped posture, and an extended paper guide plate 67 detachably mounted on the wall section 66. A plurality of sheets of paper can be stacked in the paper supplying unit 2. A paper feed motor 65 (see FIG. 3(*b*)), a feeding roller (not shown), and the like are built into the wall section 66. When driven to rotate by the paper feed motor 65, the feeding roller conveys a sheet of paper toward the printer 3.

Figure 2:
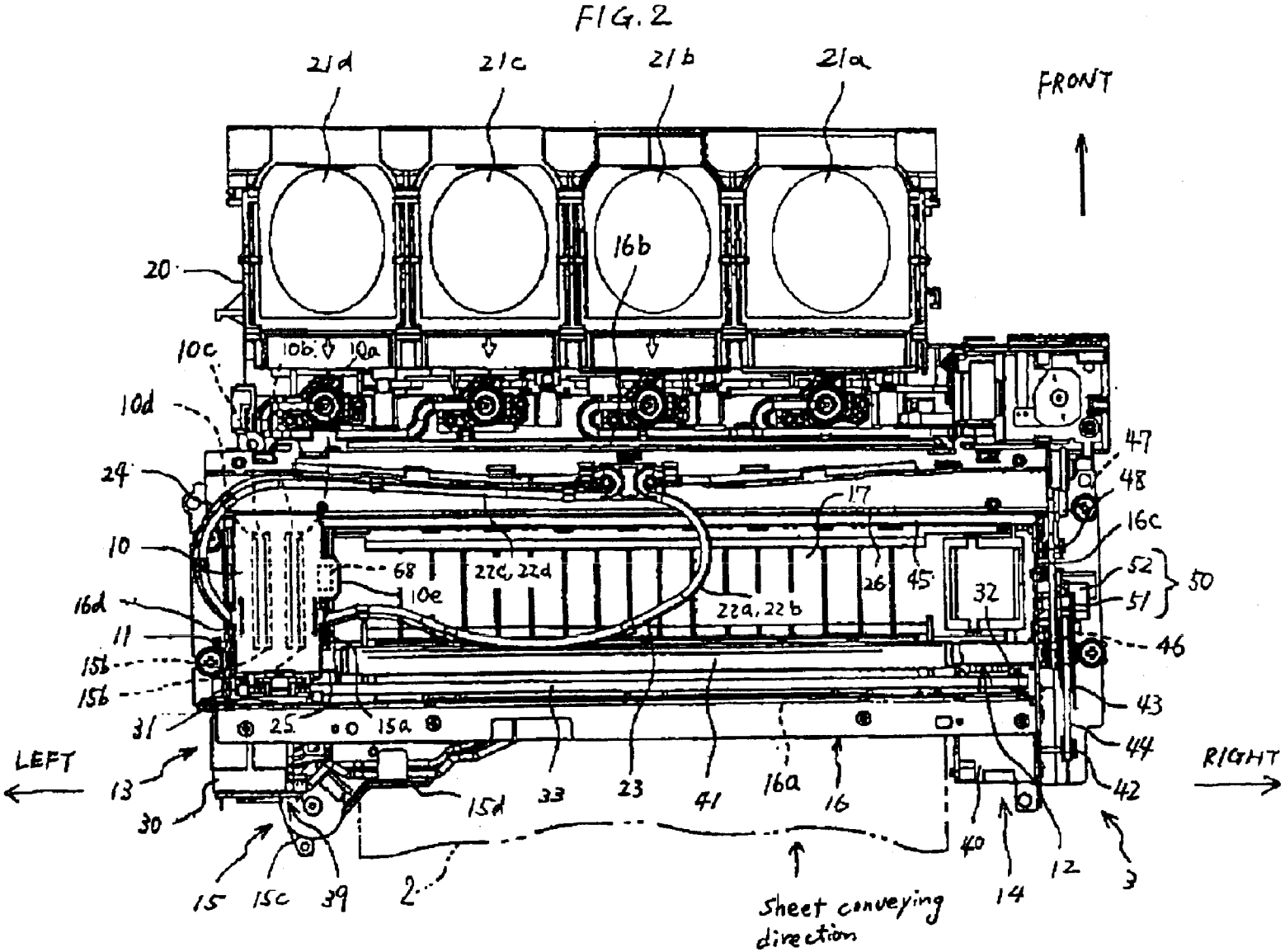
FIG. 2 is a plan view showing the internal construction of a printer provided in the multifunction device.

Next the printer 3 will be described in greater detail. FIG. 2 is a plan view showing the internal construction of the printer 3.

As shown in FIG. 2, the printer 3 includes a print head 10, a carriage 11, a guide mechanism 12, a carriage moving mechanism 13, a paper conveying mechanism 14, and a maintenance mechanism 15 for the print head 10. The print head 10 is mounted on the carriage 11. The guide mechanism 12 supports and guides the carriage 11 so that the carriage 11 can move reciprocally in a scanning direction, which is the right-to-left direction in FIG. 2. The carriage moving mechanism 13 moves the carriage 11 reciprocally in the right-to-left direction. The paper conveying mechanism 14 conveys paper supplied by the paper supplying unit 2.

A rectangular frame 16 that is long in the left-to-right dimension and that is short in the front-to-rear direction is provided in the printer 3. Various components are mounted on the rectangular frame 16, including the guide mechanism 12, carriage moving mechanism 13, paper conveying mechanism 14, and maintenance mechanism 15. The print head 10 and carriage 11 are also accommodated inside the rectangular frame 16 so as to be capable of moving reciprocally left and right.

The rectangular frame 16 includes a rear plate 16*a* and a front plate 16*b*. A paper introducing opening and paper discharging opening (not shown) are formed in the rear plate 16*a* and front plate 16*b*, respectively. Paper supplied by the paper supplying unit 2 is introduced into the rectangular frame 16 via the paper introducing opening, conveyed to the front of the rectangular frame 16 by the paper conveying mechanism 14, and discharged through the paper discharging opening onto the discharge tray 5 (FIG. 1) on the front of the multifunction device 1. A black platen 17 having a plurality of ribs is mounted on the bottom surface of the rectangular frame 16. The print head 10 performs a printing operation on paper inside the rectangular frame 16 as the paper moves over the black platen 17.

The print head 10 is provided with four sets of ink nozzles 10*a*–10*d* that point downward. Paper is printed on by ejecting four colors (black, cyan, yellow, and magenta) of ink downward through these sets of ink nozzles 10*a*–10*d*. Since the four sets of ink nozzles 10*a*–10*d* are disposed on the bottom side of the print head 10, their positions are represented by broken lines in FIG. 2.

Ink cartridges 21*a*–21*d* for each of the four colors are mounted in a cartridge holder 20 on the front side of the rectangular frame 16. The ink cartridges 21*a*–21*d* are connected to the print head 10 via four flexible ink tubes 22*a*–22*d* that pass through the rectangular frame 16 in order to supply ink of each of the four colors to the print head 10.

Flexible printed circuits (FPC) 23 and 24 are disposed inside the rectangular frame 16. The FPC 23 extends together with the flexible ink tube 22*a* and flexible ink tube 22*b* and connects to the print head 10. The FPC 24 extends together with the flexible ink tube 22*c* and flexible ink tube 22*d* and connects to the print head 10. The FPCs 23 and 24 include a plurality of signal lines that electrically connect the print head 10 to a control process unit 70 (shown in FIG. 3(*b*)) described later.

The guide mechanism 12 has a guide shaft 25 and a guide rail 26. The guide shaft 25 extends left-to-right in the back part of the rectangular frame 16. The both ends of the guide shaft 25 are coupled with plates 16*c* and 16*d*, respectively, of the rectangular frame 16. The guide rail 26 extends left-to-right in the front part of the rectangular frame 16. The rear end of the carriage 11 is fitted over the guide shaft 25 so as to be capable of sliding along the same, while the front end of the carriage 11 is engaged with the guide rail 26 and capable of sliding along the same.

The carriage moving mechanism 13 includes a carriage motor 30, a drive pulley 31, a follow pulley 32, and a belt 33. The carriage motor 30 is mounted on the rectangular frame 16 at the rear side of the rear plate 16*a* on its left end and facing front. The drive pulley 31 is rotatably supported on the left end of the rear plate 16*a* and is driven to rotate by the carriage motor 30. The follow pulley 32 is rotatably supported on one end (right end) of the rear plate 16*a*. The belt 33 is looped around the pulleys 31 and 32 and fixed to the carriage 11. A carriage conveyance encoder 39 is disposed near the carriage motor 30 for detecting movement (position) of the carriage 11 (print head 10).

The paper conveying mechanism 14 includes a paper conveying motor 40, a registration roller 41, a drive pulley 42, a follow pulley 43, and a belt 44. The paper conveying motor 40 is mounted facing rightward on the portion of the plate 16*c* that protrudes further rearward than the rear plate 16*a*. The registration roller 41 extends in the left-to-right direction in the rectangular frame 16 below the guide shaft 25. The both ends of the registration roller 41 are rotatably supported in the plates 16*c* and 16*d*, respectively. The drive pulley 42 is driven to rotate by the paper conveying motor 40. The follow pulley 43 is coupled to the right end of the registration roller 41. The belt 44 is looped around the pulleys 42 and 43. When the paper conveying motor 40 is driven, the registration roller 41 rotates and conveys paper in the rear-to-front direction. While the registration roller 41 is emphasized in FIG. 2, the registration roller 41 is actually disposed beneath the guide shaft 25.

The paper conveying mechanism 14 further includes a discharge roller 45, a follow pulley 46, a follow pulley 47, and a belt 48. The discharge roller 45 extends in the left-to-right direction in the front section of the rectangular frame 16. The both ends of the discharge roller 45 are rotatably supported in the plates 16*c* and 16*d*, respectively. The follow pulley 46 is integrally provided with the follow pulley 43. The follow pulley 47 is coupled to the right end of the discharge roller 45. The belt 48 is looped around the pulleys 46 and 47. When the paper conveying motor 40 is driven, the discharge roller 45 rotates and discharges paper toward the discharge tray 5 in the front of the multifunction device 1.

An encoder disk 51 is fixed to the follow pulley 43. A photo interrupter 52 having a light-emitting unit and a light-receiving unit is mounted on the plate 16*c* such that the encoder disk 51 is interposed between the light-emitting unit and light-receiving unit. The encoder disk 51 and photo interrupter 52 together make up a paper conveyance encoder 50. The control process unit 70 described later controls the driving of the paper conveying motor 40 based on detection signals from the paper conveyance encoder 50 (more specifically, from the photo interrupter 52).

The maintenance mechanism 15 includes a wiper 15*a*, two caps 15*b*, and a drive motor 15*c*. The wiper 15*a* wipes the surface of the print head 10. Each of the caps 15*b* can hermetically seal two sets of the ink nozzles 10*a*–10*d*. The drive motor 15*c* drives both of the wiper 15*a* and caps 15*b*. The wiper 15*a*, caps 15*b*, and drive motor 15*c* are mounted on a mounting plate 15*d*. The mounting plate 15*d* is fixed to the lower surface side of the bottom plate of the rectangular frame 16 at its left portion. Since the caps 15*b* are disposed on the bottom side of the print head 10, dotted lines indicate the positions of the caps 15*b* on the opposite side in FIG. 2.

Figure 3A:
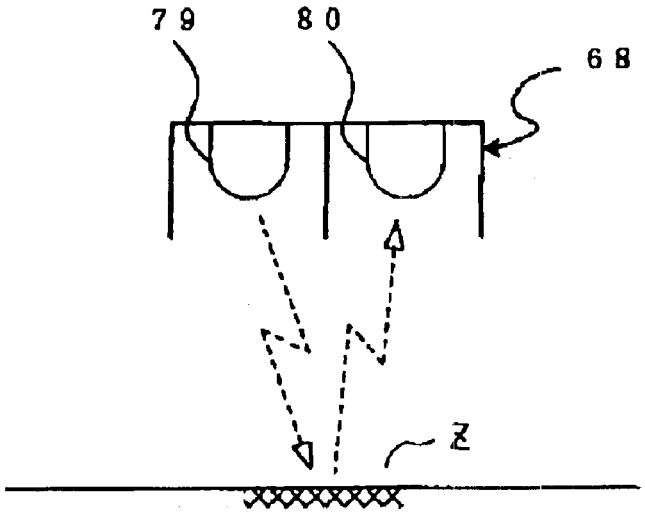
FIG. 3(*a*) is an explanatory diagram illustrating the operations of a media sensor employed in the printer.
Figure 3B:
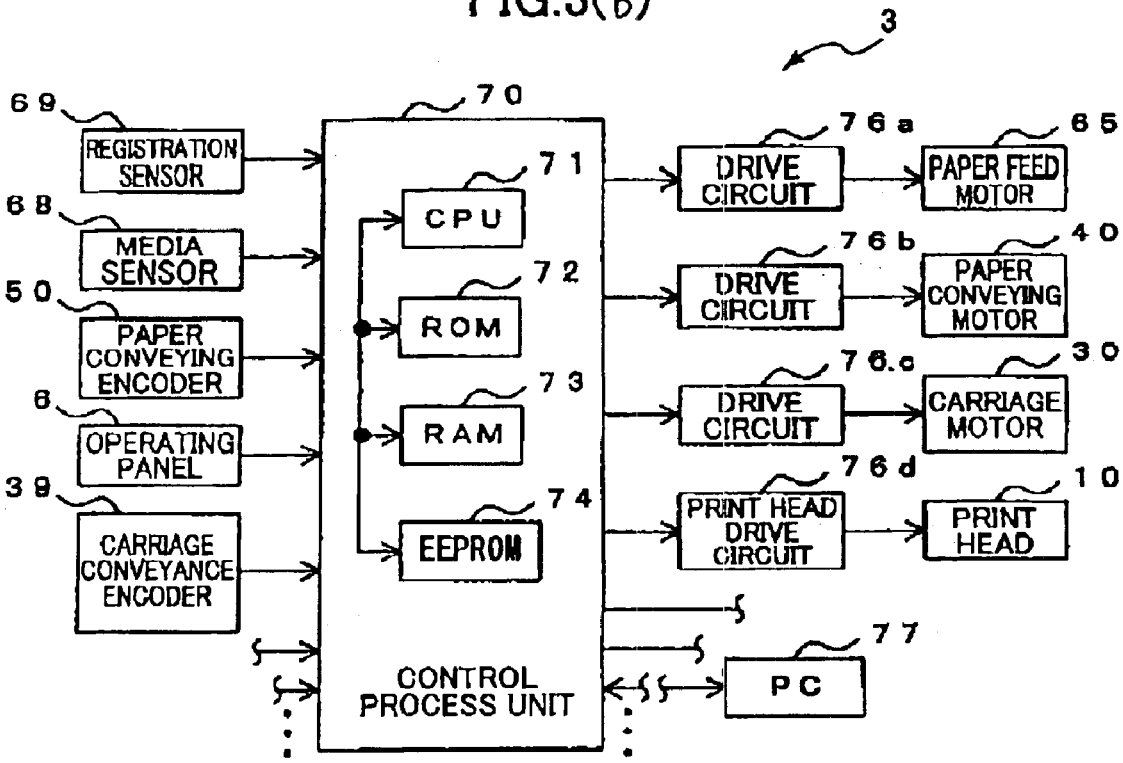

As shown in FIG. 2, a media sensor 68 is provided on the right end of the print head 10 as a downstream sensor for detecting the leading edge, trailing edge, and widthwise edges of the paper. The media sensor 68 is a reflection-type optical sensor that includes a light-emitting element 79 (light-emitting diode) and a light-receiving unit 60 (phototransistor) as shown in FIG. 3(*a*). The media sensor 68 is mounted face down on a sensor mounting unit 10*e* that protrudes to the right side of the print head 10.

More specifically, as shown in FIG. 2, the sensor mounting unit 10*e* protrudes from the right side of the print head 10. The media sensor 68 is mounted on the sensor mounting unit 10*e* for detecting the leading edge, trailing edge, and side edges of the paper P. As shown in the explanatory diagram of FIG. 3(*a*), the media sensor 68 is a reflection-type optical sensor that includes the light-emitting element 79 (light-emitting diode in the preferred embodiment) and the light-receiving element 80 (phototransistor in the preferred embodiment). A target detection area Z is defined for the media sensor 68 as such an area that when the media sensor 68 emits light from the light-emitting element 79, light reflected from the target detection area Z will be received by the light-receiving element 80. The target detection area Z moves together with the carriage 11 when the carriage 11 moves in the carriage moving direction. When the paper P is not present on the target detection area Z, the light-receiving element 80 receives light reflected from the black platen 17. The amount of light received by the light-receiving element 80 approaches a value of zero (0). When the paper P is present on the target detection area Z, the light-receiving element 80 receives a much larger amount of reflected light from the paper P than when the paper P is absent on the target detection area Z. This is because the paper P is generally white in color. Hence, the output value from the media sensor 68 (specifically, the voltage outputted by the light-receiving element 80) is at the HIGH level when the paper P is present on the target detection area Z and at the LOW level when the paper P is not present on the target detection area Z. When an edge of the paper P is present on the target detection area Z, both the paper P and the black platen 17 are present on the target detection area 2. Accordingly, the output value from the media sensor 68 (specifically, the voltage outputted by the light-receiving element 80) has a value that is between the HIGH and LOW levels and that depends on the percentage of the area occupied by the paper P and the black platen 17 in the target detection area z.

In addition, a registration sensor 69 (see FIG. 3(*b*)) is disposed upstream (rearward) of the media sensor 68 in the paper conveying direction as the upstream sensor for detecting the existence of paper and the leading edge and trailing edge of the paper. More specifically, the registration sensor 69 is mounted in the front end of a top cover (not shown) provided in the paper supplying unit 2 that forms a conveying path in the paper supplying unit 2.

The registration sensor 69 can be configured, for example, by a mechanical sensor having a probe, a photo interrupter, and a torsion spring. The probe protrudes into the paper conveying path and rotates when contacted by the paper. The photo interrupter includes a light-emitting unit and a light-receiving unit for detecting rotation of the probe. The torsion spring urges the probe into the paper conveying path. A shielding part is integrally provided on the probe. When the probe is rotated by contact from paper, the shielding part becomes positioned in regions outside the area between the light-emitting unit and the light-receiving unit of the photo interrupter. Therefore, when light is transmitted from the light-emitting unit to the light-receiving unit, the registration sensor 69 is in an ON state. Since the probe is urged into the paper conveying path by the torsion spring when paper is not being conveyed, the shielding part becomes positioned between the light-emitting unit and light-receiving unit of the photo interrupter at this time. Hence, the shielding part interrupts the transmission of light from the light-emitting unit to the light-receiving unit, placing the registration sensor 69 in an OFF state.

Next, the control process unit 70 will be described in greater detail. FIG. 3(*b*) is a block diagram showing the electric configuration of the control process unit 70.

As shown in FIG. 3(*b*), the control process unit 70 includes a microcomputer having a CPU 71, a ROM 72, a RAM 73, and an EEPROM 74. The registration sensor 69, media sensor. 66, paper conveyance encoder 50, operating panel 6, carriage conveyance encoder 39, and the like are electrically connected to the control process unit 70.

Also electrically connected to the control process unit 70 are drive circuits 76*a*–76*c*, and a print head drive circuit 76*d*. The drive circuits 76*a*–76*c* drive the paper feed motor 65, the paper conveying motor 40, and the carriage motor 30, respectively. The print head drive circuit 76*d* drives the print head 10. The control process unit 70 is also capable of being connected to a personal computer 77.

Next, a process for adjusting media sensor operations executed by the control process unit 70 will be described with reference to FIG. 4.

Figure 4:
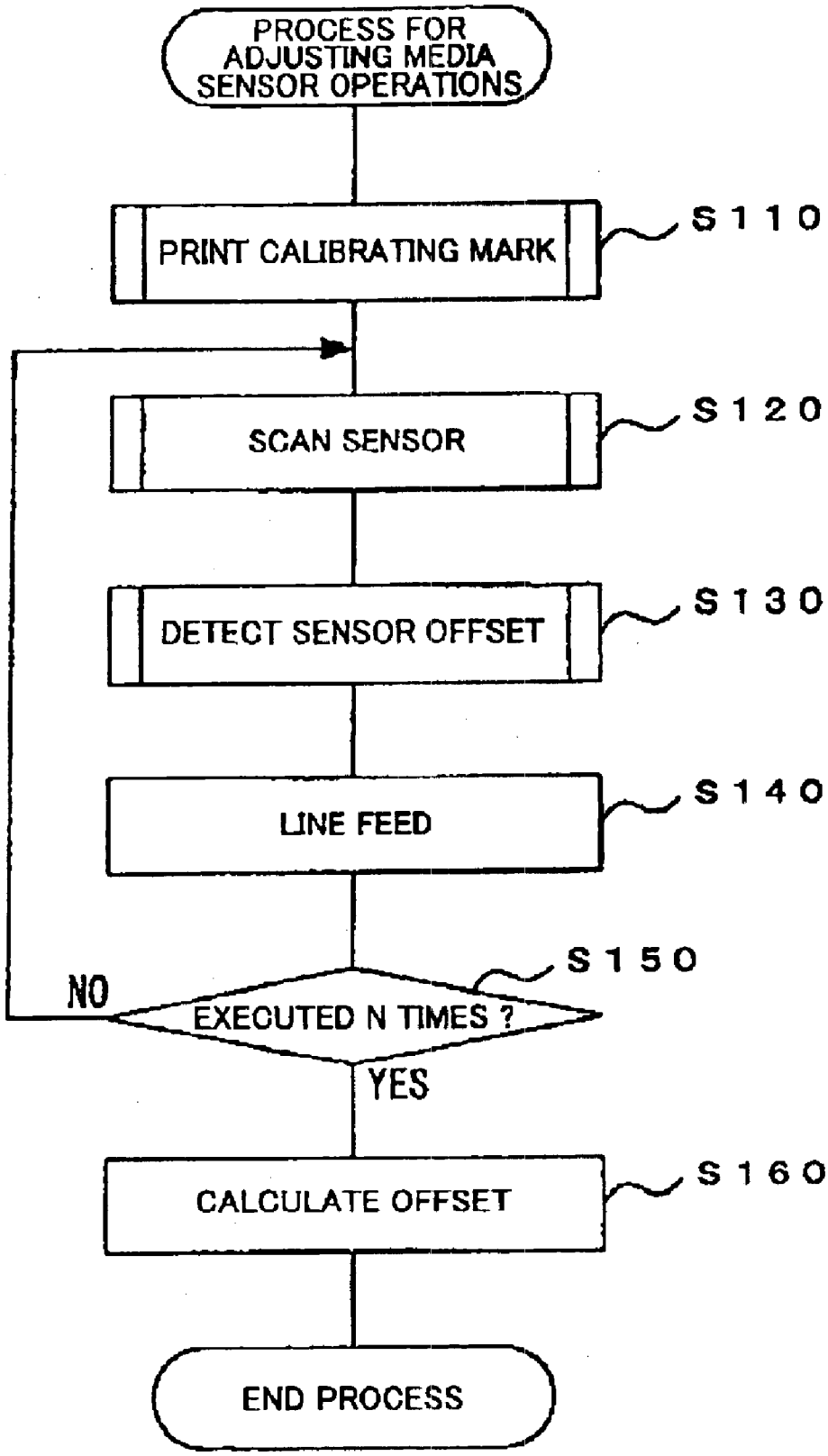
FIG. 4 is a flowchart showing the steps in a process for adjusting operations of a media sensor.

FIG. 4 is a flowchart showing the steps in this process. This process is for determining the difference between a detecting position by the media sensor 68 and a printing position by the print head 10 on the carriage 11. The process for adjusting media sensor operations is executed as part of factory inspections performed on the multifunction device 1 prior to shipment. Hence, the process is initiated when an inspector inputs a command to execute the process into the multifunction device 1 using inspection tools, for example. A repairman may also execute this process during repairs on the print head 10, carriage 11, or media sensor 68.

At the beginning of the process for adjusting the media sensor operations, in S110, the CPU 71 executes a subroutine for printing a calibrating mark.

Figure 6:
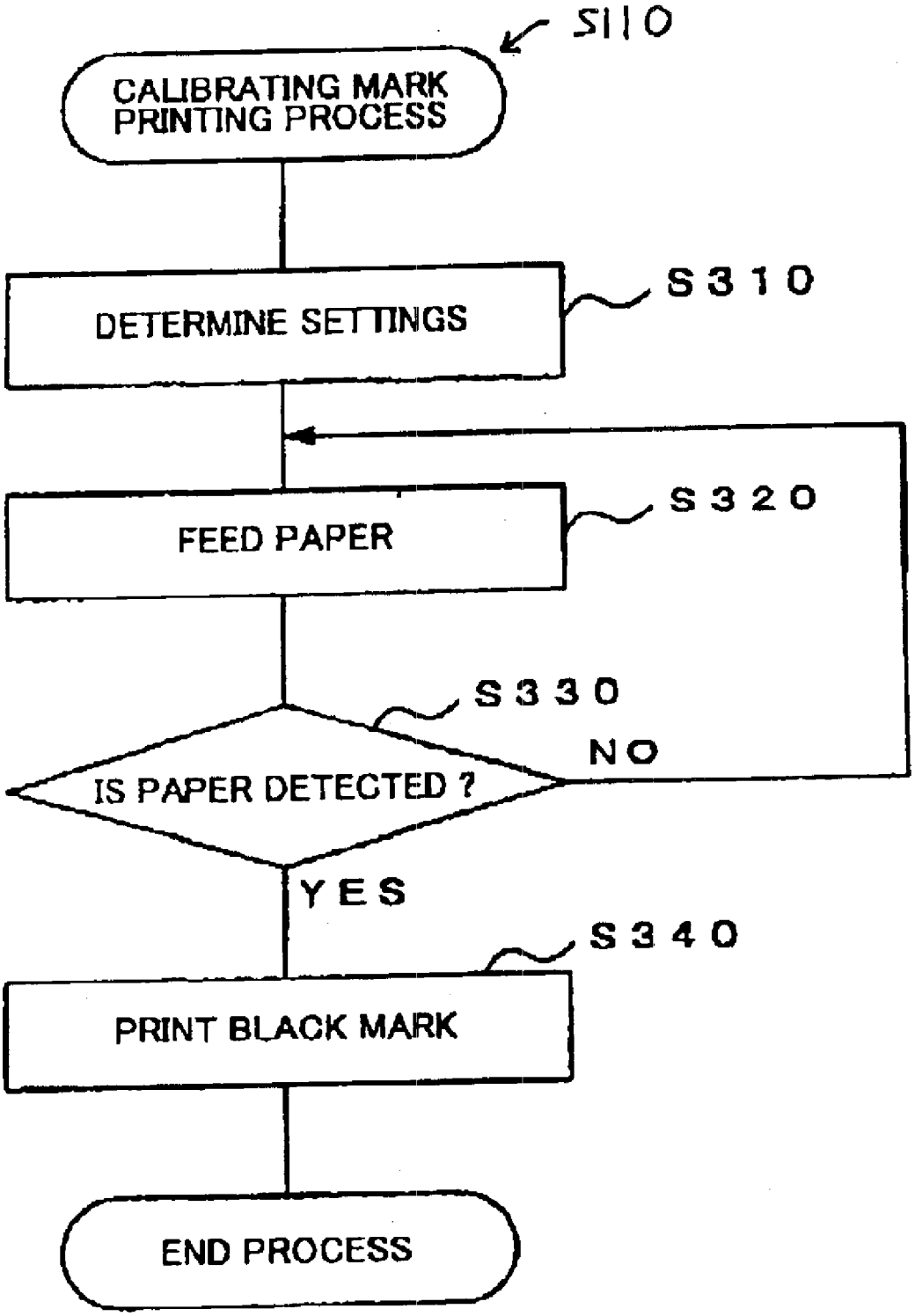
FIG. 6 is a flowchart showing the steps in a calibrating mark printing process in the process of FIG. 4.

FIG. 6 is a flowchart showing the steps in the process for printing a calibrating mark.

At the beginning of the calibrating mark printing process, in S310, the CPU 71 executes a process for determining various settings used in the calibrating mark printing process. For examples settings can be set to values inputted by the inspector through operations on the operating panel 6.

Figure 10:
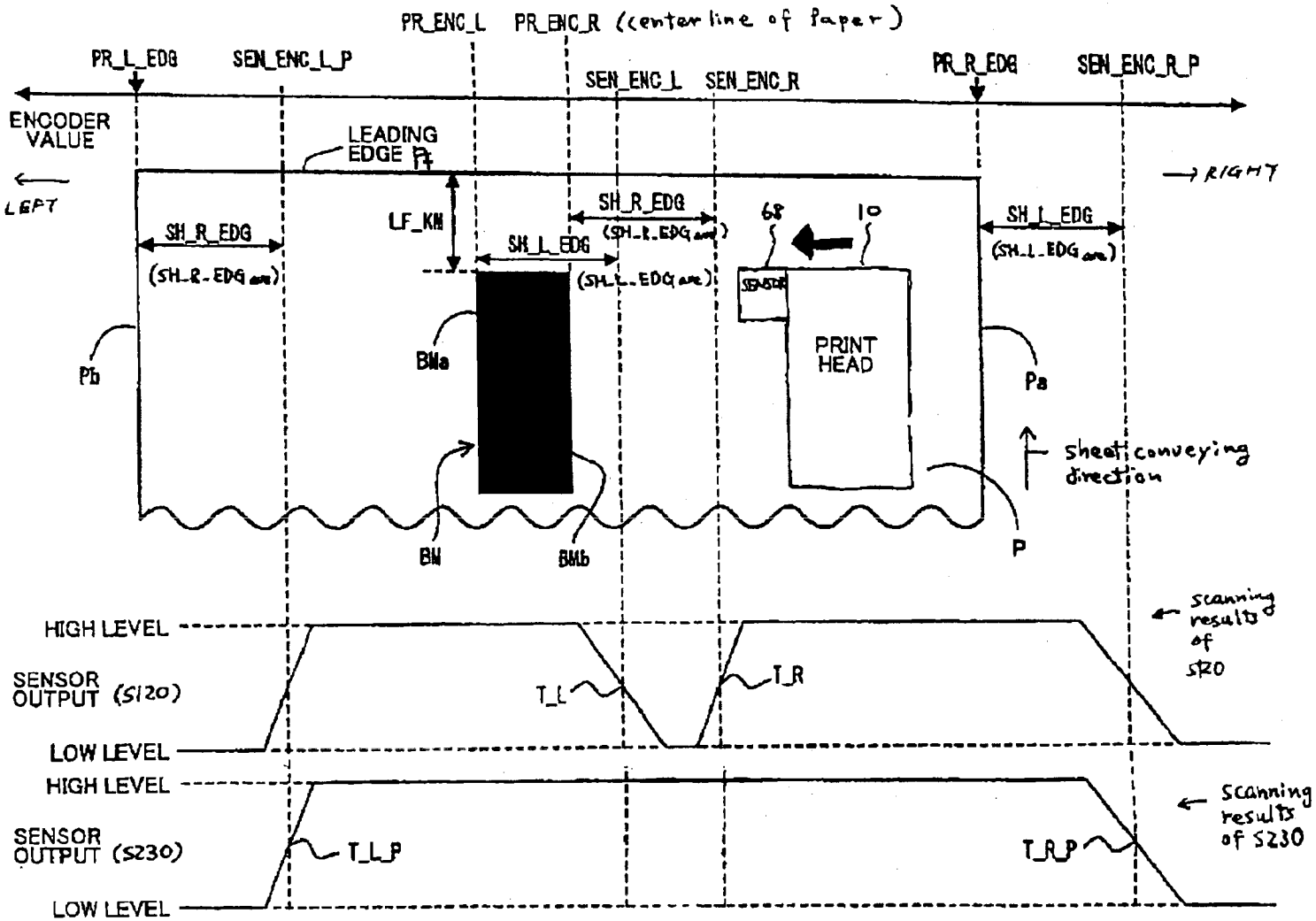
FIG. 10 is an explanatory diagram showing the relationships among a paper printed with a black mark, encoding values from a carriage conveyance encoder, and output values from a media sensor.

Settings in S310 include a line feed distance LF_KM, a paper determining reference PAPER_JDG, and encoder values from the carriage conveyance encoder 39 including an encoder value PR_ENC_R for printing a right edge of a black mark BM and an encoder value PR_ENC_L for printing a left edge of the black mark BM. As shown in FIG. 10, the line feed distance LF_KM is the distance from a leading edge Pf of the paper P to the front end of the black mark BM. The paper determining reference PAPER_JDG is a reference value used for determining the presence of the paper P based on output values from the media sensor 68. Encoder value PR_ENC_R is a value for the carriage conveyance encoder 39 indicative of the position where a right edge (right mark edge BMb) of the black mark BM should be printed on the paper P. Encoder value PR_ENC_L is a value for the carriage conveyance encoder 39 indicative of the position where a left edge (left mark edge BMa) of the black mark BM should be printed on the paper P. These settings are stored in the memory 73, 74, or another storage unit (not shown in FIG. 3(*b*)).

In S320 the CPU 71 controls the driving of the paper feed motor-65 to feed a sheet of the paper P to be used for this media-sensor-operation adjusting process from the paper supplying unit 2 to the printer 3. The CPU 71 also controls the driving of the paper conveying motor 40 in the paper conveying mechanism 14 to convey the paper P in a sheet conveying direction as shown in FIG. 2 until the paper P is detected by the registration sensor 69. When the registration sensor 69 detects the paper P, the paper P is further conveyed in the sheet conveying direction until the paper P is detected by the media sensor 68. The detection of the paper P by the media sensor 68 is executed by comparing the sensor output from the media sensor 68 with the paper determining reference PAPER_JDG. When the sensor output exceeds the value PAPER_JDG, it is known that the leading edge of the paper P (see FIG. 10) reaches the position below the media sensor 68.

When the media sensor 68 detects the paper P, the paper P is further conveyed by the line feed distance LF_KM from the point of detection by the media sensor 68. Subsequently, the motors are stopped, halting the operation to convey the paper P.

In S330, presence of the paper P is determined by comparing the output value from the media sensor 68 to the paper determining reference PAPER_JDG. More specifically, the CPU 71 compares the output value from the media sensor 68 with the paper determining reference PAPER_JDG to determine whether the paper P has been conveyed into the printing area of the print head 10. If the paper P is present in this printing area (S330: YES), the CPU 71 advances to S340. If not (S330: NO), the CPU 71 returns to S320.

The media sensor 68 outputs a HIGH level when detecting paper (when detecting white) and a LOW level when not detecting paper but detecting the black platen 17 (when detecting black). Hence, if the output value of the sensor is smaller than the paper determining reference PAPER_JDG (when not detecting paper), the CPU 71 reaches a negative determination (no in S330). If the output value is greater than or equal to the paper determining reference PAPER_JDG (when detecting paper), the CPU 71 reaches a positive determination (yes in S330).

When a negative determination is reached in S330, the CPU 71 returns to S320 and again controls the driving of the paper feed motor 65 and the paper conveying motor 40. Hence, the processes in S320 and S330 are repeated until the CPU 71 determines that the paper P is present in the printing area of the print head 10 (positive determination).

When the CPU 71 reaches a positive determination in S330, then in S340 the black mark BM is printed in a widthwise region of the paper P from the encoder value PR_ENC_R for the right mark edge BMb to the encoder value PR_ENC_L for the left mark edge BMa. That is, the carriage 11 is moved in the widthwise direction of the paper. While the detection value of the carriage conveyance encoder 39 is between the encoder values PR_ENC_L and PR_ENC_R, the print head 10 is controlled to print black ink on the paper. At this time, the printing mode is set to a high-resolution mode, such as 600×600 dpi, in order to allow the media sensor 68 to distinguish the right mark edge BMb and left mark edge BMa accurately during a sensor scanning process of S120 to be described later. The black mark BM is printed in a region spanning a predetermined distance in the conveying direction of the paper P beginning from a position exactly the line feed distance LF_KM from the leading edge Pf toward the trailing edge of the paper P as shown in FIG. 10.

After completing the process in S340, the process for printing the calibrating mark ends, and the CPU 71 returns to the process for adjusting the media sensor operations (FIG. 4).

In this manner, the process for printing a calibrating mark of S110 is executed to print the black mark BM within the predetermined region of the paper P (the region between the encoder value PR_ENC_R and the encoder value PR_ENC_L).

FIG. 10 illustrates the relationships between the paper P on which the black mark BM has been printed, encoder values for the carriage conveyance encoder 39, and output values from the media sensor 68.

As shown in FIG. 10, the black mark BM is printed on the paper P in a widthwise region from the encoder value PR_ENC_R to the encoder value PR_ENC_L and beginning from a position exactly line feed distance LF_KM from the leading edge Pf in a direction toward the trailing edge of the paper P.

There is no particular restriction on the size of the black mark BM, provided that the output value from the media sensor 68 will sufficiently change when the media sensor 68 scans the black mark BM during the sensor scanning process of S120.

For example, it is possible to use all ink nozzles 10*a*–10*d* of the print head 10 to print a wide black mark BM or to use only a portion of the nozzles. When using only a portion of the nozzles, it is preferable to print with those nozzles that are positioned on the upstream side of the media sensor 68 in the sheet conveying direction indicated by arrows in FIGS. 2 and 10, in consideration for the scanning process of the sensor 68 executed later. When using all of the nozzles, since the scanning region of the media sensor 68 is narrower than the length of the nozzle rows, it is sufficient that at least a portion of the black mark BM remains on the upstream side of the media sensor 68 in the sheet conveying direction after the print head 10 has completed recording the black mark BM at a prescribed density.

After completing the process for printing a calibrating mark (S110), the CPU 71 initiates a subroutine for scanning the media sensor 68 in S120.

Figure 7:
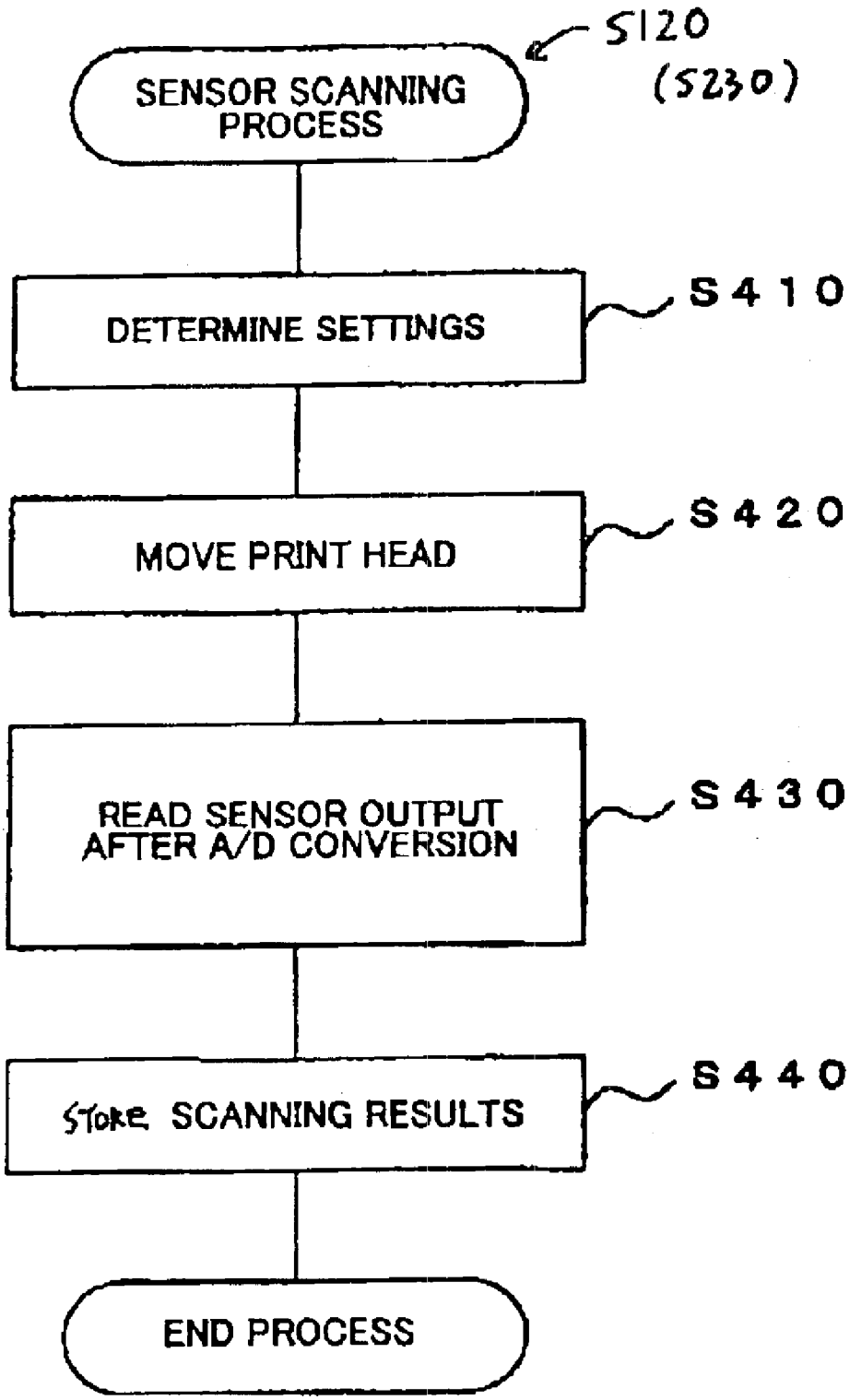
FIG. 7 is a flowchart showing the steps in a sensor scanning process in the process of FIG. 4.

FIG. 7 is a flowchart showing the steps in the sensor scanning process (S120). At the beginning of the sensor scanning process, in S410, the CPU 71 determines all settings used for the process. For example, the settings can be set to values inputted by the inspector through operations on the operating panel 6.

The settings determined in S410 include a scanning start position AD_START and a scanning end position AD_END. The scanning start position AD_START represents an encoder value corresponding to the start position of a region (sensor reading area) in which output values from the media sensor 68 should be read. The scanning end position AD_END represents the encoder value corresponding to the end position of the sensor reading area. It is noted that the start position of the sensor reading area is right to the right edge Pa of the paper P and that the end position of the sensor reading area is left to the left edge Pb of the paper P. Thus, the entire width of the paper P is located completely inside the sensor reading area.

In S420 the CPU 71 initiates a process to move the print head 10 by controlling the driving of the carriage motor 30 to move the carriage 11 from right to the left in the widthwise direction of the sheet. By setting the velocity of the carriage 11 slower than during a normal printing process (such as 1 ips), scanning precision of the media sensor 68 can be improved.

In S430 the CPU 71 repeatedly reads an analog output value from the media sensor 68 at a fixed interval (an interval of 300 dpi, for example) in the region from the scanning start position AD_START to the scanning end position AD_END, and repeatedly obtains a digital output value by converting the analog output value through analog-to-digital conversion by using an analog-to-digital converter (not shown in the figure) that is provided between the media sensor 68 and the CPU 71.

Every time the CPU 71 obtains a digital output value by the analog-to-digital conversion from the media sensor 68, the CPU 71 creates a set of scanning data SEN_AD by associating the digital output value with an encoder value that is obtained from the carriage conveyance encoder 39 at the time the output value has been obtained. The CPU 71 therefore creates a plurality of sets of scanning data SEN_AD because the CPU 71 obtains the digital output value repeatedly at the fixed interval while the carriage 11 moves in the reading area from the scanning start position AD_START to the scanning end position AD_END.

In S440, the CPU 71 stores the plurality of sets of scanning data SEN_AD in memory 73, 74, or in another storage unit.

After completing S440, the sensor scanning process of S120 ends, and the process returns to the process of FIG. 4.

Hence, during the sensor scanning process of S120, the CPU 71 acquires and stores the plurality of sets of scanning data SEN_AD, each data set SEN_AD including a sensor output value and an encoder value obtained within the reading area between the scanning start position AD_START and the scanning end position AD_END.

After completing the sensor scanning process (S120), the CPU 71 initiates a subroutine for detecting a sensor offset in S130.

Figure 8:
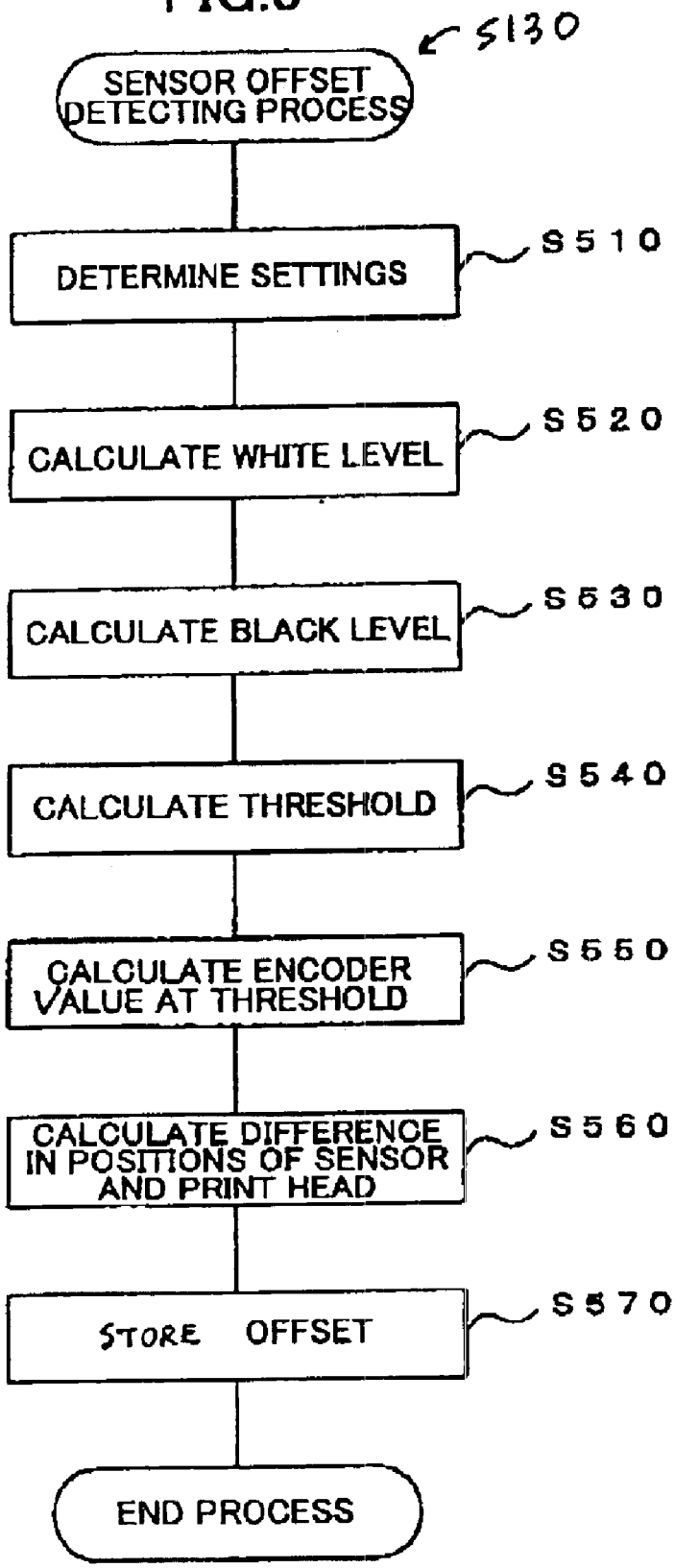
FIG. 8 is a flowchart showing the steps in a process to detect sensor offset in the process of FIG. 4.

FIG. 8 is a flowchart showing the steps in the sensor offset detecting process (S130).

At the beginning of the sensor offset detecting process, in S510, the CPU 71 determines all settings used for the process.

The settings determined in S510 include a white level pixel number WLEV_NUM, a black level pixel number BLEV_NUM, a right mark edge determining ratio TH_R, and a left mark edge determining ratio TH_L.

The white level pixel number WLEV_NUM is the number of data entries (pixel number) that is used for calculating a white detection level value Wslev based on the sensor outputs from the media sensor 68. The black level pixel number BLEV_NUM is the number of data entries (pixel number) that is used for calculating a black detection level Bslev based on sensor outputs from the media sensor 68. The right mark edge determining ratio TH_R is used for setting a right mark edge determining threshold T_R that is used for detecting the right mark edge BMb of the black mark BM. The left mark edge determining ratio TH_L is used to set a left mark edge determining threshold T_L that is used for detecting the left mark edge BMa of the black mark BM. Values of these settings WLEV_NUM, BLEV_NUM, TH_R, and TH_L are previously determined and stored in memory 73, 74 or another storage unit. The CPU 71 therefore reads out the values from the memory or storage unit and sets those values to be used for the process of S130. For example, the values TH_L and TH_R are 50%, respectively.

Further, in S510, the CPU 71 reads from the memory or storage unit the scanning data SEN_AD which have been stored in S440 of the sensor scanning process (S120 (FIG. 7)), and the encoder values PR_ENC_R and PR_ENC_L which have been determined in S310 of the process for printing a calibrating mark (S110 (FIG. 6)).

In S520 the CPU 71 performs a process to calculate a white detection level Wslev, which is indicative of an output value that the media sensor 68 outputs when detecting the paper P. More specifically, the CPU 71 extracts, from all the sets of scanning data SEN_AD, exactly the white level pixel number WLEV_NUM sets of scanning data, whose output values are greater than those of the other remaining sets of scanning data. In other words, the CPU 71 extracts the white level pixel number WLEV_NUM sets of scanning data, whose output values are the greatest through the WLEV_NUM-th greatest among the output values in all the sets of scanning data SEN_AD. The CPU 71 then calculates an average of the sensor output values in the extracted WLEV_NUM sets of data entries, and sets the calculated average value as the white detection level Wslev.

In S530 the CPU 71 performs a process to calculate a black detection level Bslev, which is indicative of an output value that the media sensor 68 outputs when detecting the black mark BM. More specifically, the CPU 71 extracts, from all the sets of scanning data SEN_AD, exactly the black level pixel number BLEV_NUM sets of scanning data, whose output values are smaller than those of the other remaining sets of scanning data. In other words, the CPU 71 extracts the black level pixel number BLEV_NUM sets of scanning data, whose output values are the smallest through the BLEV_NUM-th smallest among the output values in all the sets of scanning data SEN_AD. The CPU 71 then calculates an average of the sensor output values in the extracted BLEV_NUM sets of data entries, and sets the calculated average value as the black detection level Bslev.

In S540 the CPU 71 calculates the right mark edge determining threshold T_R according to Equation 1 below and the left mark edge determining threshold T_L using Equation 2 below.

$$T_R=(Bslev-Wslev)\times(TH_R)+Wslev \quad \text{Equation 1}$$

$$T_L=(Bslev-Wslev)\times(TH_L)+Wslev \quad \text{Equation 2}$$

In S550 the CPU 71 extracts, from all the sets of scanning data SEN_AD, an encoder value SEN_ENC_R that is associated with a sensor output that is equal to the right mark edge determining threshold T_R and another encoder value SEN_ENC_L that is associated with another sensor output that is equal to the left mark edge determining threshold T_L.

In other words, the CPU 71 extracts an encoder value SEN_ENC_R (see FIG. 10) that is outputted from the carriage conveyance encoder 39 when the sensor output of the media sensor 68 reaches the right mark edge determining threshold T_R and another encoder value SEN_ENC_L (see FIG. 10) that is outputted from the carriage conveyance encoder 39 when the sensor output reaches the left mark edge determining threshold T_L.

The process of S550 will be described in more detail with reference to FIG. 10.

The scanning results of S120 indicate that while the media sensor 68 moves from the right (scanning start position) to the left (scanning end position), the sensor output first increases from low to high at the right paper edge Pa, decreases from high to low at the right mark edge BMb, again increases from low to high at the left mark edge BMa, and again decreases from high to low at the left paper edge Pb as shown in FIG. 10. The sensor output therefore becomes equal to the right mark edge determining threshold T_R four times, and becomes equal to the left mark edge determining threshold T_L four times.

It is previously known that the difference between the detection position of the media sensor 68 and the printing position of the print head 10 is greater than a predetermined minimum distance MIN and lower than a predetermined maximum distance MAX. It is therefore previously known that the encoder value SEN_ENC_R should be greater than the value of PR_ENC_R−MAX and smaller than the value of PR_ENC_R−MIN and that the encoder value SEN_ENC_L should be greater than the value of PR_ENC_L−MAX and smaller than the value of PR_ENC_L−MIN.

Accordingly, in S550, in order to determine the encoder value SEN_ENC_R, the CPU 71 first determines four encoder values, at which the associated sensor output value is equal to the right mark edge determining threshold T_R. Then, the CPU 71 selects, from among these four encoder values, one encoder value that is greater than the value of PR_ENC_R−MAX and smaller than the value of PR_ENC_R−MIN.

Similarly, in order to determine the encoder value SEN_ENC_L, the CPU 71 first determines four encoder values, at which the associated sensor output value is equal to the left mark edge determining threshold T_L. Then, the CPU 71 selects, from among these four encoder values, one encoder value that is greater than the value of PR_ENC_L−MAX and smaller than the value of PR_ENC_L−MIN.

Although not shown in the drawing, before executing the process of S550, the CPU 71 executes an interpolation process to convert the plurality of sets of scanning data SEN_AD, which have been obtained in S120 at the interval of 300 dpi, into a greater number of scanning data sets SEN_AD that are equivalent to 2,400 dpi. The CPU 71 extracts in S550 the encoder values SEN_ENC_R and SEN_ENC_L from among the thus increased scanning data sets SEN_AD in the above-described manner. It is possible to improve the precision in extracting the encoder values SEN_ENC_R and SEN_ENC_L.

In S560 the CPU 71 calculates offsets, which are indicative of the difference in positions of the media sensor 68 and the print head 10. Specifically, the CPU 71 calculates the difference in positions of the print head 10 and the media sensor 68 for the right mark edge BMb based on Equation 3 below, and sets the result of this calculation as an encoder offset SH_R_EDG for the right mark edge BMb. Further, the CPU 71 calculates the difference in positions of the print head 10 and the media sensor 68 for the left mark edge BMa using Equation 4 below, and sets this calculated result as an encoder offset SH_L_EDG for the left mark edge BMa.

$$SH_R_EDG=(PR_ENC_R)-(SEN_ENC_R) \quad \text{Equation 3}$$

$$SH_L_EDG=(PR_ENC_L)-(SEN_ENC_L) \quad \text{Equation 4}$$

The encoder offset SH_R_EDG is the difference between the encoder value PR_ENC_R that is obtained when the print head 10 prints the right mark edge BMb and the encoder value SEN_ENC_R that is obtained when the media sensor 68 detects the right mark edge BMb. Further, the encoder offset SH_L_EDG is the difference between the encoder value PR_ENC_L that is obtained when the print head 10 prints the left mark edge BMa and the encoder value SEN_ENC_L that is obtained when the media sensor 6B detects the left mark edge BMa.

In S570 the CPU 71 stores the encoder offset SH_R_EDG and the encoder offset SH_L_EDG in the memory 73, 74, or the other storage unit (not shown).

After completing the process in S570, the CPU 71 ends the process to detect sensor offset of S130, and the program returns to the process of FIG. 4.

In this way, during the process of S130 for detecting sensor offset, the CPU 71 calculates the encoder offset SH___EDG and encoder offset SH_L_EDG for the right mark edge BMb and left mark edge BMa, respectively, using the differences between the encoder values when printing the black mark BM and the encoder values when detecting the black mark BM.

After the CPU 71 completes the process for detecting sensor offset of S130 and returns to the process for adjusting media sensor operations (FIG. 4), the CPU 71 controls driving of the paper conveying motor 40 in S140 to perform a line feed process to convey the paper P a predetermined distance toward the front of the printer 3, that is, in the sheet conveying direction as indicated by an arrow in FIG. 10. An LF counter variable is assigned to the number of times the line feed process has been executed. The conveying distance is set to a distance at least shorter than a value calculated by dividing the length of the black mark BM in the sheet conveying direction by N, where N represents a number (an integer greater than one (eight, for example)) that is used in the determination of S150 of the following step. In other words, the conveying distance is set such that the media sensor 68 can detect the black mark BM when the line feed process is executed N times.

In S150 the CPU 71 determines based on the LF counter variable whether a line feed process in S140 has been executed N times or more.

If the LF counter variable is equal to or greater than N (S150:YES), then the CPU 71 advances to S160. If not (S150:NO), then the CPU 71 returns to S120.

In S160 the CPU 71 extracts, from the memory 73, 74 or the other storage unit, all the N-number of encoder offset values SH_R_EDG that have been obtained by executing the process of S130 N times. The CPU 71 excludes the highest and lowest values from among the N-number of encoder offset values SH_R_EDG. The CPU 71 calculates an average value $SH_R_EDG_{ave}$ for the (N-2) number of encoder offset values SH_R_EDG.

Similarly, the CPU 71 extracts, from the memory 73, 74, or the other storage unit, all the N-number of encoder offset values SH_L_EDG that have been obtained by executing the process of S130 N times. The CPU 71 excludes the highest and lowest values from among the N-number of encoder offset values SH_L_EDG. The CPU 71 calculates an average value $SH_L_EDG_{ave}$ for the (N-2) number of encoder offset values SH_L_EDG.

In S160, the CPU 71 stores the encoder offset average $SH_R_EDG_{ave}$ and the encoder offset average value $SH_L_EDG_{ave}$ in the memory 73, 74, or the other storage unit so that the values can be used in an edge-to-edge printing process of FIG. 5 described later.

After completing the process in S160, the process for adjusting the media sensor operations ends. Hence, by executing the process for adjusting media sensor operations, the CPU 71 calculates the encoder offset values SH_R_EDG and SH_L_EDG at the plurality of locations on the black mark BM along the sheet conveying direction, calculates the encoder offset average values $SH_R_EDG_{ave}$ and $SH_L_EDG_{ave}$, and stores these encoder offset average values $SH_R_EDG_{ave}$ and $SH_L_EDG_{ave}$ in the memory or storage unit.

It is noted that if printing precision of the print head 10 varies in the widthwise direction, it is preferable to print the calibrating mark BM so that either one of the right mark edge BMb and the left mark edge BMa is located at the position where the printing precision is the highest. For example, if the printing precision is the highest on the centerline of the paper P in the widthwise direction, it is preferable to print the calibrating mark BM so that either one of the right mark edge BMb and the left mark edge BMa is located on the center line of the sheet of paper P. It is possible to further improve accuracy in setting either one of the encoder offsets SH_L_EDG and SH_R_EDG. In the example of FIG. 10, the right mark edge BMb is located on the center line of the paper P.

Next, an edge-to-edge printing process for printing images to the edges of the paper P will be described.

Figure 5:
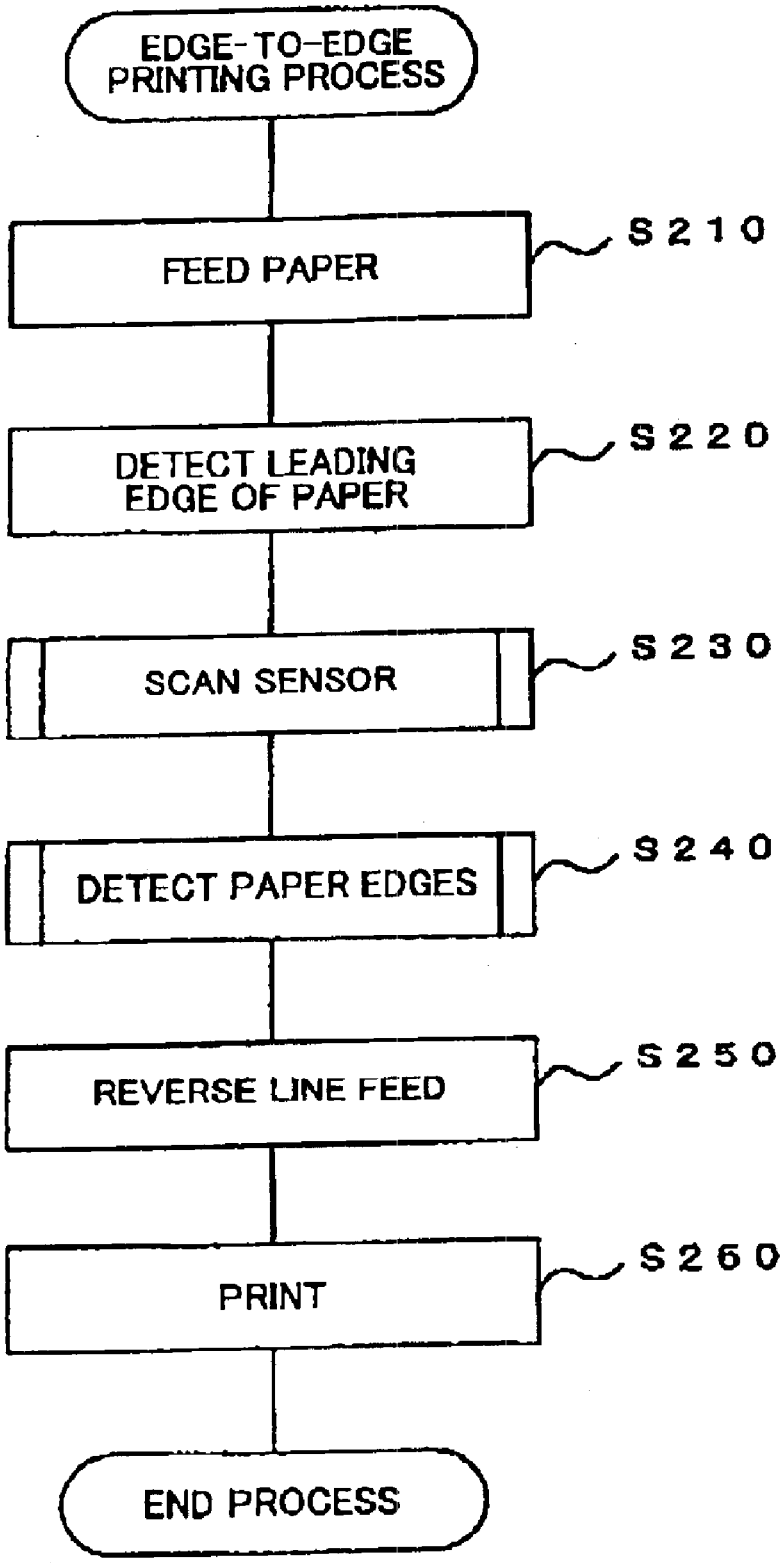
FIG. 5 is a flowchart showing the steps in an edge-to-edge printing process.

FIG. 5 is a flowchart showing steps in the edge-to-edge printing process. The edge-to-edge printing process begins when a user or the like inputs a printing request into the multifunction device 1.

At the beginning of the edge-to-edge printing process, in S210, the CPU 71 controls the driving of the paper feed motor 65 to feed a sheet of paper P desired to be printed from the paper supplying unit 2 to the printer 3. The CPU 71 also controls the driving of the paper conveying motor 40 in the paper conveying mechanism 14 to convey the paper P in a direction toward the front side of the printer 3, that is, in the sheet conveying direction as indicated by arrows in FIGS. 2 and 10.

In S220 the leading edge Pf of the paper P is detected by the media sensor 68. Thereafter, the paper P is further conveyed toward the front of the printer 3, that is, in the sheet conveying direction a predetermined distance before the conveying is stopped. This conveying distance is set to a distance for conveying the paper P to a position at which the media sensor 68 can reliably detect both side edges of the paper P (right edge Pa and left edge Pb).

In S230 the CPU 71 initiates the sensor scanning process of a subroutine.

The steps in the sensor scanning process of S230 are identical to those of the sensor scanning process of S120 (FIG. 7). By executing the sensor scanning process in S230, the CPU 71 creates a plurality of sets of scanning data SEN_AD while the media sensor 68 is moved from right to the left in the widthwise direction of the paper P. The CPU 71 stores the plurality of sets of scanning data SEN_AD in the memory 73, 74 or the other storage unit. Each data set SEN_AD includes a sensor output and an encoder value that is obtained by the carriage conveyance encoder 39 at the time when the sensor output is obtained.

In S240, the CPU 71 executes a subroutine for detecting side edges of the paper.

Figure 9:
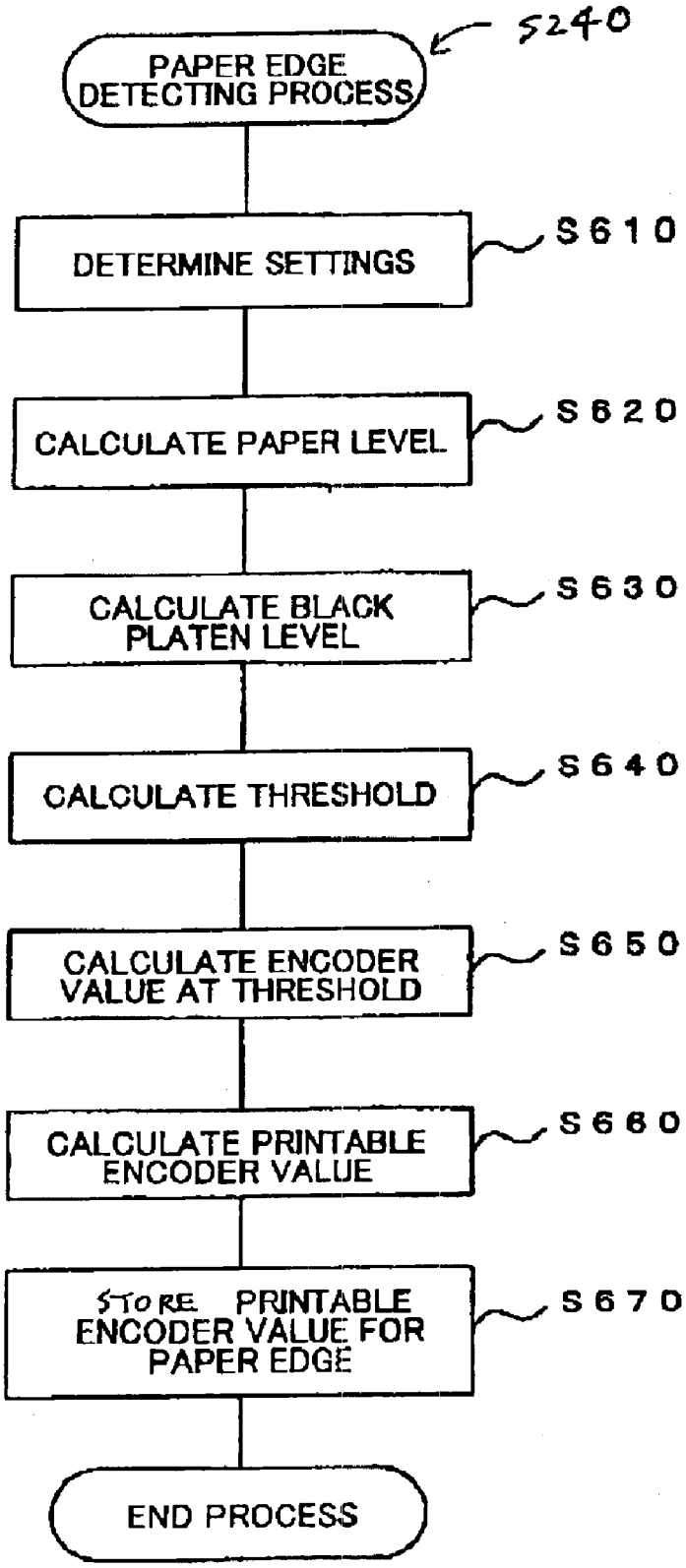
FIG. 9 is a flowchart showing the steps in a paper edge detecting process in the process of FIG. 5.

FIG. 9 is a flowchart showing the steps in the process for detecting side edges of the paper.

At the beginning of the paper edge detecting process, in S610, the CPU 71 executes a process for determining various settings used in the paper edge detecting process.

Settings determined in S610 include a paper white level pixel number WLEV_NUM_P, a platen black level pixel number BLEV_NUM_P, a paper right edge determining ratio TH_R_P, and a paper left edge determining ratio TH_L_P. The paper white level pixel number WLEV_NUM_P is the number of data entries (pixel number) that is used for calculating a paper white detection level WslevP based on sensor output values from the media sensor 68. The platen black level pixel number BLEV_NUM_P is the number of data entries (pixel number) that is used for calculating a platen black detection level BslevP based on sensor output values from the media sensor 68. The paper right edge determining ratio TH_R_P is used for setting a paper right edge determining threshold T_R_P. The paper left edge determining ratio TH_L_P is used for setting a paper left edge determining threshold T_L_P. Values of these settings WLEV_NUM_P, BLEV_NUM_P, TH_R_P, and TH_L_P are previously determined and stored in the memory 73, 74, or the other storage unit. The CPU 71 therefore reads out the values from the memory or storage unit and sets those values to be used for the process of S240. For example, the values TH_L_P and TH_R_P are 50%, respectively.

Also in S610 the CPU 71 reads, from the memory or storage unit, all the sets of scanning data SEN_AD that have been stored in the sensor scanning process of S230.

In S620 the CPU 71 performs a process to calculate a paper white detection level WslevP, which is indicative of an output value that the media sensor 68, outputs when detecting the paper P. More specifically, the CPU 71 extracts, from all the sets of scanning data SEN_AD, exactly the paper white level pixel number WLEV_NUM_P sets of scanning data, whose output values are greater than those of the other remaining sets of scanning data. In other words, the CPU 71 extracts the paper white level pixel number WLEV_NUM_P sets of scanning data, whose output values are the greatest through the WLEV_NUM_P-th greatest among the output values in all the sets of scanning data SEN_AD. The CPU 71 then calculates an average of the sensor output values in the extracted WLEV_NUM_P sets of data entries, and sets the calculated average value as the paper white detection level WslevP.

In S630 the CPU 71 performs a process to calculate a platen black detection level BslevP, which is indicative of an output value that the media sensor 68 outputs when detecting the black platen 17. More specifically, the CPU 71 extracts, from all the sets of scanning data SEN_AD, exactly the platen black level pixel number BLEV_NUM_P sets of scanning data, whose output values are smaller than those of the other remaining sets of scanning data. In other words, the CPU 71 extracts the platen black level pixel number BLEV_NUM_P sets of scanning data, whose output values are the smallest through the BLEV_NUM_P-th smallest among the output values in all the sets of scanning data SEN_AD. The CPU 71 then calculates an average of the sensor output values in the extracted BLEV_NUM_P sets of data entries, and sets the calculated average value as the platen black detection level BslevP.

In S640 the CPU 71 calculates a paper right edge determining threshold T_R_P using Equation 5 below and a paper left edge determining threshold T_L_P using the Equation 6 below.

$$T_R_P=(BslevP-WslevP)\times(TH_R_P)+WslevP \quad \text{Equation 5}$$

$$T_L_P=(BslevP-WslevP)\times(TR_L_P)+WslevP \quad \text{Equation 6}$$

In S650 the CPU 71 extracts, from all the sets of scanning data SEN_AD, an encoder value SEN_ENC_R_P that is associated with a sensor output that is equal to the paper right edge determining threshold T_R_P and another encoder value SEN_ENC_L_P that is associated with another sensor output that is equal to the paper left edge determining threshold T_L_P. In other words, the CPU 71 extracts an encoder value SEN_ENC_R_P (see FIG. 10) that is outputted from the carriage conveyance encoder 39 when the sensor output of the media sensor 68 reaches the paper right edge determining threshold T_R_P and another encoder value SEN_ENC_L_P (see FIG. 10) that is outputted from the carriage conveyance encoder 39 when the sensor output reaches the paper left edge determining threshold T_L_P.

The process of S650 will be described in more detail with reference to FIG. 10.

The scanning results of S230 indicate that while the media sensor 68 moves from the right (scanning start position) to the left (scanning end position), the sensor output first increases from low to high at the right paper is edge Pa and then decreases from high to low at the left paper edge Pb as shown in FIG. 10. Accordingly, in S650, in order to determine the encoder value SEN_ENC_R_P, the CPU 71 first determines a range of the encoder value, at which the associated sensor output value increases from the right to the left. Then, the CPU 71 selects, from this sensor-output increasing range, one encoder value SEN_ENC_R_P at which the associated sensor output is equal to the paper right edge determining threshold T_R_P. Similarly, in order to determine the encoder value SEN_ENC_L_P, the CPU 71 first determines another range of the encoder value, at which the associated sensor output value decreases from the right to the left. Then, the CPU 71 selects, from this sensor-output decreasing range, one encoder value SEN_ENC_L_P at which the associated sensor output is equal to the paper left edge determining threshold. T_L_P.

Although not shown in the drawing, before executing the process of S650, the CPU 71 executes an interpolation process to convert the plurality of sets of scanning data SEN_AD that have been obtained in S230 at the interval of 300 dpi into a greater number of scanning data sets SEN_AD that are equivalent to 2,400 dpi. In S650, the CPU 71 extracts the encoder values SEN_ENC_R_P and SEN_ENC_L_P from among the thus number-increased scanning data sets SEN_AD in the above-described manner. It is possible to improve the precision in extracting the encoder values SEN_ENC_P and SEN_ENC_L_P.

In S660 the CPU 71 calculates a range of encoder values at which printing on the paper P is possible. More specifically, the CPU 71 calculates an encoder value that will be obtained by the carriage conveyance encoder 39 when the print head 10 is positioned at the right edge Pa of the paper P by calculating Equation 7 below, and sets the result of this calculation as a paper right edge printable encoder value PR_R_EDG. In addition, the CPU 71 calculates an encoder value that will be obtained by the carriage conveyance encoder 39 when the print head 10 is positioned at the left edge Pb of the paper P by calculating Equation 8 below, and sets the resulting value as a paper left edge printable encoder value PR_L_EDG.

$$PR_R_EDG=(SEN_ENC_R_P)+(SH_L_EDG_{ave}) \quad \text{Equation 7}$$

$$PR_L_EDG=(SEN_ENC_L_P)+(SH_R_EDG_{ave}) \quad \text{Equation 8}$$

It is noted that the values $SH_L_EDG_{ave}$ and $SH_R_EDG_{ave}$ are encoder offset average values that have been calculated and stored in the memory or storage unit in S160 of the process of FIG. 4.

In this way, the paper right edge printable encoder value PR_R_EDG is a value calculated by adding the encoder offset average value $SH_L_EDG_{ave}$ at the left mark edge BMa to the paper right edge detection encoder value SEN_ENC_R_P. The paper left edge printable encoder value PR_L_EDG is a value calculated by adding the encoder offset average value $SH_R_EDG_{ave}$ at the right mark edge BMb to the paper left edge detection encoder value SEN_ENC_L_P.

In S670 the CPU 71 stores the paper right edge printable encoder value PR_R_EDG and the paper left edge printable encoder value PR_L_EDG in the memory 73,74 or the other storage unit.

After completing the process in S670, the CPU 71 ends the paper edge detecting process of S240, and the process returns to the process of FIG. 5.

In this way, during the paper edge detecting process, the CPU 71 calculates encoder values PR_R_EDG and PR_L_EDG that will be outputted from the carriage conveyance encoder 39 when the print head 10 is positioned on both widthwise edges of the paper P (the right edge Pa and left edge Pb). By executing this paper edge detecting process of S240, it is possible to learn the encoder values the carriage conveyance encoder 39 will output when the print head 10 is positioned on these edges. The printable region of the paper P can be set based on these encoder values.

After completing the paper edge detecting process of S240 and returning to the edge-to-edge printing process of FIG. 5, in S250 the CPU 71 drives the paper conveying motor 40 in the reverse direction to perform a reverse line feed process in which the paper P is conveyed a fixed distance toward the rear of the printer 3, that is, in a direction opposite to the sheet conveying direction indicated by the arrows in FIGS. 2 and 10. This process moves the leading edge Pf of the paper P to a position corresponding to the print head 10.

In S260, text, graphics, and the like which correspond to a printing request that has been inputted by the user or the like are printed on the paper P. Specifically, the text, graphics, and the like are printed on the paper P by ejecting prescribed colors of ink from the ink nozzles based on the conveying position of the paper P and the moving position of the print head 10. The print head 10 is moved between the positions indicated by the encoder values PR_R_EDG and PR_L_EDG of the carriage conveyance encoder 39, thereby printing images between the edges of the paper P.

After completing the process in S260, the CPU 71 ends the edge-to-edge printing process.

In this way, the printer 3 can print text, graphics, and the like on the paper P in response to a printing request from a user or the like. During this process, the printer 3 can accurately detect both side edge positions of the paper P (the right edge Pa and the left edge Pb), achieving an image-forming operation with superior accuracy in printing near the side edges of the paper P.

In the example described above with reference to FIG. 10, the width of the paper P used in the edge-to-edge printing process of FIG. 5 is equal to that of the paper P used in the media-sensor-operations adjusting process of FIG. 4. However, the width of the paper used in the edge-to-edge printing process of FIG. 5 may be different from that of the paper used in the media-sensor-operations adjusting process of FIG. 4. Papers with any widths can be used in the edge-to-edge printing process of FIG. 5.

As described above, by executing the black mark printing process of S110, the printer 3 prints the black mark BM as a calibrating mark that can be detected by the media sensor 68. The black mark BM includes the left mark edge BMa for which detection results of the media sensor 68 (changes in sensor output) are substantially identical to those at the right edge Pa of the paper P and the right mark edge BMb for which detection results of the media sensor 68 are substantially identical to those at the left edge Pb of the paper P.

By executing the process for detecting sensor offset in S130, the printer 3 sets the encoder offset SH_L_EDG based on the difference between the carriage position (encoder value PR_ENC_L) that is detected when the left mark edge BMa is printed by the print head 10 and the carriage position (encoder value SEN_ENC_L) that is detected when the left mark edge BMa is detected with the media sensor 68. Similarly, the printer 3 sets the encoder offset SH_R_EDG based on the difference between the carriage position (encoder value PR_ENC_R) that is detected when the right mark edge BMb is printed by the print head 10 and the carriage position (encoder value SEN_ENC_R) that is detected when the right mark edge BMb is detected with the media sensor 68.

By executing the paper edge detecting process of S240, the printer 3 uses the encoder offset SH_L_EDG as indicative of the distance between the media sensor 68 and the carriage 11 to calculate the encoder value (paper right edge printable encoder value PR_R_EDG) that will be outputted from the carriage conveyance encoder 39 when the print head 10 (carriage 11) is positioned at the right edge Pa of the paper P. In the same process, the printer 3 uses the encoder offset SH_R_EDG as indicative of the distance between the media sensor 68 and the carriage 11 to calculate the encoder value (paper left edge printable encoder value PR_L_EDG) that will be outputted from the carriage conveyance encoder 39 when the print head 10 (carriage 11) is disposed at the left edge Pb of the paper P.

The differences (SH_L_EDG and SH_R_EDG) between the encoder values indicative of the position of the carriage 11 that is detected when the print head 10 prints the black mark BM and the encoder values indicative of the position of the carriage 11 when the media sensor 68 detects the black mark BM corresponds to the actual distance between the media sensor 68 and the carriage 11 (print head 10). It is possible to suppress the effects of errors in mounting the media sensor 68 to the carriage 11 by using the encoder offsets SH_L_EDG and SH_R_EDG, thereby preventing a decline in accuracy for detecting edges of the paper P.

In particular, the printer 3 prints the black mark BM having the left mark edge BMa and right mark edge BMb on the paper P, and sets the distance offsets (encoder offset SH_L_EDG and encoder offset SH_R_EDG) based on the differences between positions (encoder values) of the carriage 11 when the print head 10 prints the black mark BM and when the media sensor 68 detects the black mark BM at both the left mark edge BMa and the right mark edge BMb. In this way, the printer 3 can set distance offsets individually for the right edge. Pa and the left edge Pb of the paper P and can prevent a drop in precision for detecting both edges of the paper P caused by error in mounting the media sensor 68.

Therefore, the printer 3 can prevent a decline in detection accuracy due to mounting error of the media sensor 68 and the carriage 11, and can improve accuracy in detecting both edges of the paper P (the right edge Pa and the left edge Pb). Further, by improving accuracy in detecting the edges of the paper P, the printer 3 can improve printing accuracy by accurately positioning the carriage 11 at desired positions in areas near the edges of the paper P.

The printer 3 includes the media sensor 68, which is a reflection-type optical sensor that serves to detect the paper P. The output value from the sensor changes according to changes in reflectance of the target detection area z. Hence, the printer 3 detects the right edge Pa and left edge Pb of the paper P based on changes in output from the media sensor 68. The right edge Pa and left edge Pb are identified according to whether the sensor output is increasing or decreasing.

In the above-described example, the carriage 11 is moved from right to the left. Accordingly, the right edge Pa is identified according to whether the sensor output is increasing, and the left edge Pb is identified according to whether the sensor output is decreasing. The right mark edge BMb of the black mark BM is identified according to whether the sensor output is decreasing, and the left mark edge BMa is identified according to whether the sensor output is increasing. Thus, detection results of the media sensor 68 (changes in sensor output) for the left mark edge BMa are substantially identical to those at the right edge Pa of the paper P, while detection results of the media sensor 68 (changes in sensor output) for the right mark edge BMb are substantially identical to those at the left edge Pb of the paper P.

It is noted that if the carriage 11 is moved from left to the right, the left edge Pb will be identified according to whether the sensor output is increasing, and the right edge Pa will be identified according to whether the sensor output is decreasing. In this case, the right mark edge BMb of the black mark BM will be identified according to whether the sensor output is increasing, and the left mark edge BMa will be identified according to whether the sensor output is decreasing. Thus, detection results of the media sensor 68 (changes in sensor output) for the left mark edge BMa will be substantially identical to those at the right edge Pa of the paper P, while detection results of the media sensor 68 (changes in sensor output) for the right mark edge BMb will be substantially identical to those at the left edge Pb of the paper P.

The printer 3 separately calculates the encoder offset SH_L_EDG, which is obtained at the left mark edge BMa and which will be used for detecting the right edge Pa, and the encoder offset SH_R_EDG, which is obtained at the right mark edge BMb and which will be used for detecting the left edge Pb. Hence, the printer 3 can reliably improve precision for detecting both edges of the paper P by performing the calibrating processes individually for both the right edge Pa and left edge Pb.

In the printer 3, the black platen 17 is mounted on the bottom surface of the frame 16. The black platen 17 has a plurality of ribs on its top surface. The black platen 17 is disposed with its top surface being in confrontation with the media sensor 68 within a region over which the paper P is conveyed. In this example, the entire portion of the black platen 17 is formed in a black color, which is different from the paper P.

It is noted that the top surface of the black platen 17 has a detectable area that is detectable by the media sensor 68 when no sheet of paper P is present on the black platen 17 and when the media sensor 68 moves from the scanning start position to the scanning end position. In other words, the detectable area is such an area, on which the target detection area z of the media sensor 68 can be located according to the movement of the carriage 11. It is unnecessary that the entire portion of the black platen 17 is black in color, but it is sufficient that only the detectable area of the black platen 17 be formed in a black color.

By providing the black platen 17 with this construction, the media sensor 68 can distinguish the paper P from regions outside the paper P (black platen 17) accurately, thereby improving the accuracy of detecting edges of the paper P. Further, by disposing the black platen 17 in the region through which the paper P is conveyed, the paper P becomes interposed between the media sensor 68 and the black platen 17, allowing the media sensor 68 to detect the paper P and not the black platen 17.

During the black mark printing process of S110, the black mark BM of a color and a reflectance identical to the top surface of the black platen 17 (black) is printed on the paper P as a calibrating mark. Hence, when the media sensor 68 moves from the right side to the left side of the paper P in FIG. 10, the color in the target detection area z of the media sensor 68 changes from black to white at the left mark edge BMa, which is equivalent to the pattern of change detected from the black platen 17 (black) to the paper P (white) at the paper right edge Pa.

In other words, it is possible to produce detection results from the media sensor 68 (pattern of changes in sensor output) for the left mark edge BMa that are substantially identical to detection results from the media sensor 68 for the right edge Pa of the paper P. In this example, the carriage 11 moves from right to the left. The sensor output from the media sensor 68 changes in the increasing pattern, that is, from low level to high level when the media sensor 68 detects the paper right edge Pa. The sensor output from the media sensor 68 changes also in the increasing pattern when the media sensor 68 detects the left mark edge BMa. It is noted that if the carriage 11 moves from left to right, the sensor output from the media sensor 68 will change in the decreasing pattern, that is, from high level to low level when the media sensor 68 detects the paper right edge Pa. The sensor output from the media sensor 68 will change in the same decreasing pattern also when the media sensor 68 detects the left mark edge BMa.

Similarly it is possible to produce detection results from the media sensor 68 (a pattern of changes in sensor output) for the right mark edge BMb that are substantially identical to detection results from the media sensor 68 for the left edge Pb of the paper P. In this example, the carriage 11 moves from right to the left. Accordingly, the sensor output from the media sensor 68 changes in the decreasing pattern, that is, from high level to low level when the media sensor 68 detects the paper left edge Pb. The sensor output from the media sensor 68 changes in the same decreasing pattern when the media sensor 68 detects the right mark edge BMb. It is noted that if the carriage 11 moves from left to the right, the sensor output from the media sensor 68 will change in the increasing pattern, that is, from low level to high level when the media sensor 66 detects the paper left edge Pb. The sensor output from the media sensor 68 will change in the same increasing pattern when the media sensor 68 detects the right mark edge BMb.

Accordingly, even if the media sensor 68 has such characteristics that sensor output changes in a different manner when the sensor output increases and when the sensor output decreases, it is possible to set the encoder offsets SH_L_EDG and SH_R_EDG with high accuracy.

Hence, by improving the precision in setting offset values in distance (the encoder offset SH_L_EDG and the encoder offset SH_R_EDG) for adjusting the distance between the carriage 11 and the media sensor 68, the printer 3 can further suppress the effects of mounting errors. Accordingly, the printer 3 can further improve the accuracy for detecting edges of the paper P.

In the preferred embodiment, the black mark BM is printed in black as the calibrating mark. Since black is easier to differentiate from most colors than other colors are, the black mark BM can easily be differentiated from the area other than the black mark BM on the paper P, thereby improving the accuracy for detecting the left mark edge BMa and the right mark edge BMb. As a result, the encoder offset SH_L_EDG and encoder offset SH_R_EDG can be set with greater accuracy. It is possible to suppress the effects of mounting error and improve accuracy in detecting the edges of the paper P.

Further, the process of S120–S150 is repeatedly executed N times in the process for adjusting media sensor operations. Hence, the encoder offset SH_L_EDG and encoder offset SH_R_EDG are calculated at N different locations in the black mark BM in the sheet conveying direction. Accordingly, a plurality of values are obtained for the encoder offset SH_L_EDG and a plurality values are obtained for the encoder offset SH_R_EDG. The encoder offset average value $SH_L_EDG_{ave}$ of the plurality of values for the encoder offset SH_L_EDG and the encoder offset average value $SH_R_EDG_{ave}$ for the plurality of values for the encoder offset SH_R_EDG are determined and are used during the edge-to-edge printing process. The effects of detection errors can be more reliably suppressed when using an average of offset values for distance calculated at a plurality of locations in the black mark BM rather than when using an offset value calculated at a single location in the black mark BM.

By using the accurately-calculated encoder offset average values $SH_L_EDG_{ave}$ and $SH_R_EDG_{ave}$, it is possible to suppress the effects of mounting error and to improve the accuracy in detecting edges of the paper P.

<Modification>

Figure 11:
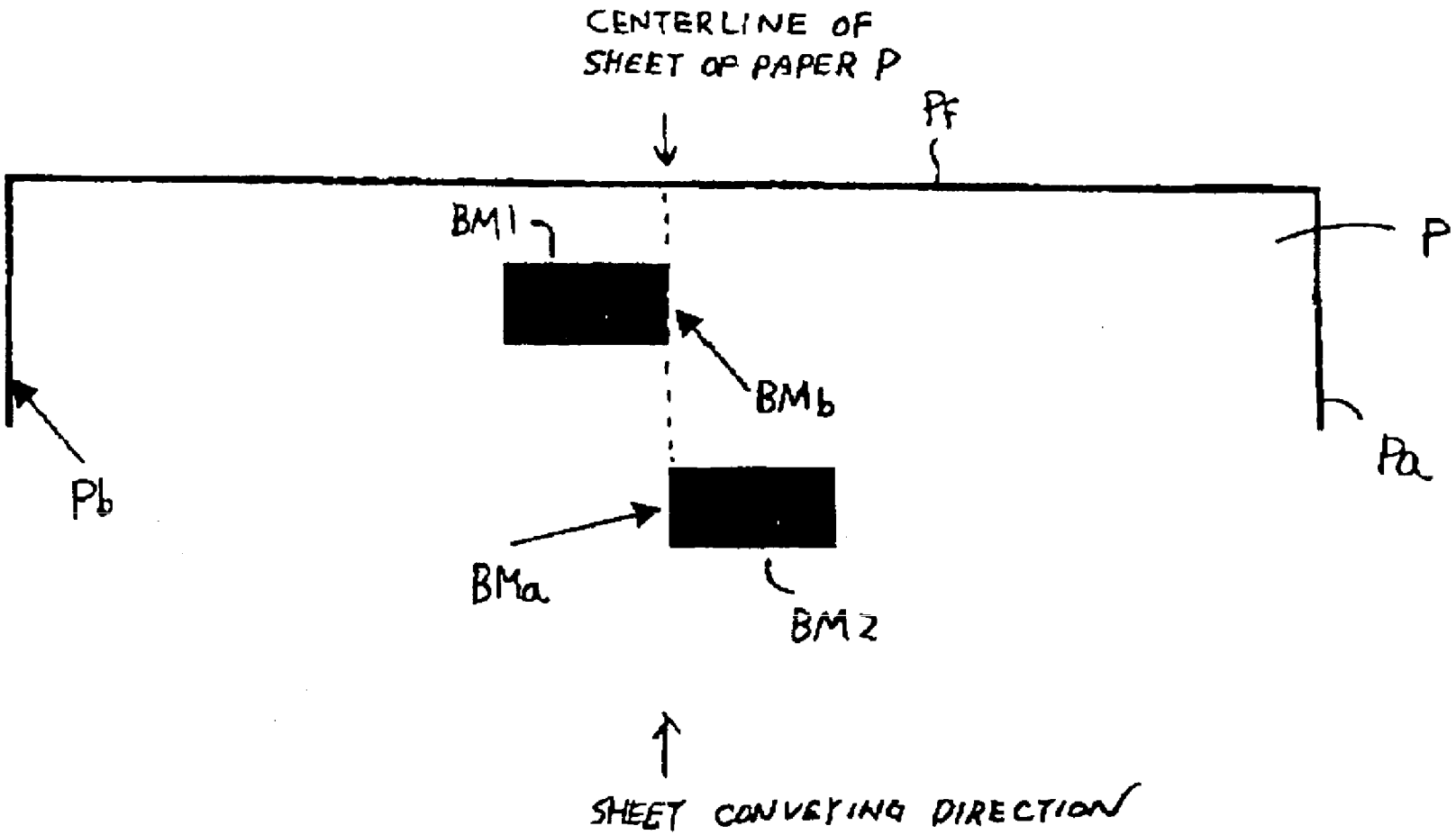
FIG. 11 is an explanatory diagram according to a modification and showing how to print two black marks on a paper.

The calibrating mark printing process of FIG. 6 may be modified to print a first calibrating mark BM1 having a right mark edge BMb and a second calibrating mark BM2 having a left mark edge BMa as shown in FIG. 11.

By thus separately printing the first calibrating mark BM1 and second calibrating mark BM2, the first calibrating mark BM1 having the right mark edge BMb can be printed at a position suitable for calculating the encoder offset SH_R_EDG, while the second calibrating mark BM2 having the left mark edge BMa can be printed at a position suitable for calculating the encoder offset SH_L_EDG.

More specifically, it is now assumed that the accuracy of printing is the highest on the centerline of the paper P in the widthwise direction. In this case, the first calibrating mark BM1 and the second calibrating mark BM2 are printed in S340 so that the right edge BMb of the first calibrating mark BM1 and the left edge BMa of the second calibrating mark BM2 are located on the center line of the sheet of paper P in the widthwise direction as shown in FIG. 11. By detecting the mark edges BMb and BMa thus printed with high accuracy in S120, it is possible to further improve accuracy in setting both of the encoder offsets SH_R_EDG and SH_L_EDG.

Especially, in this case, processes in S120, S130, S140, and S150 may be modified: to calculate the encoder offset SH___EDG for the right mark edge BMb at the N number of different locations on the right mark edge BMb in the sheet conveying direction and to determine an average value $SH_R_EDG_{ave}$ of the calculated results at the plurality of locations; and to calculate the encoder offset SH_L_EDG for the left mark edge BMa at the N number of different locations on the left mark edge BMa and to determine an average value $SH_L_EDG_{ave}$ of the calculated results at the plurality of locations. By using the accurately-calculated encoder offset average values $SH_R_EDG_{ave}$ and $SH_L_EDG_{ave}$, it is possible to further suppress the effects of mounting error and to further improve accuracy when detecting edges of the paper.

While the invention has been described in detail with reference to the specific embodiment thereof, it would be apparent to those skilled in the art that many modifications and variations may be made therein without departing from the spirit of the invention, the scope of which is defined by the attached claims.

For example, an additional process can be provided in the calibrating mark printing process of S110 (FIG. 6) for determining whether the paper conveying mechanism 14 is in an abnormal state if the number of negative determinations in S330 exceeds a specified number. If it is determined that the paper conveying mechanism 14 is in an abnormal state, then a process may be executed to notify the inspector or the like of this abnormal state.

Further, the calibrating mark is not limited to a rectangular shape as in the black mark BM of the embodiment described above. A mark of any shape may be used, provided that the mark has a right mark edge and a left mark edge that correspond to the left edge and right edge of the paper, respectively.

The platen 17 may have a color that is other than black and that is different from the color of the paper P. In such a case, it is preferable to print the black mark BM in color the same as that of the platen 17 so that the black mark BM will have a reflectance the same as that of the platen 17.

In S160, the CPU 71 calculates the average value $SH_R_EDG_{ave}$ for the (N-2) number of encoder offset values SH_R_EDG and the average value $SH_L_EDG_{ave}$ for the (N-2) number of encoder offset values SH_L_EDG. However, the CPU 71 may calculate, as the average value $SH_R_EDG_{ave}$, an average of all the N number of encoder offset values SH_R_EDG and may calculate, as the average value $SH_L_EDG_{ave}$, an average of all the N number of encoder offset values SH_L_EDG.

In the above description, the encoder offset value SH_R_EDG is calculated for the N number of different locations on the right mark edge BMb, and the average value $SH_R_EDG_{ave}$ of the (N-2) number of calculated results is used during the edge-to-edge printing process, and the encoder offset value SH_L_EDG is calculated for the N number of different locations on the left mark edge BMa and the average value $SH_L_EDG_{ave}$ of the (N-2) number of calculated results is used during the edge-to-edge printing process. However, the encoder offset value SH_R_EDG may be calculated only for a single location on the right mark edge BMb and may be used as it is during the edge-to-edge printing process. The encoder offset value SH_L_EDG may be calculated only for a single location on the left mark edge BMa and may be used as it is during the edge-to-edge printing process. In this case, the Equations 7 and 8 are modified into Equations 7' and 8' as described below and are used to calculate the paper right edge printable encoder value PR_R_EDG and the paper left edge printable encoder value PR_L_EDG.

$$PR_R_EDG=(SEN_ENC_R_P)+(SH_L_EDG) \quad \text{Equation 7'}$$

$$PR_L_EDG=(SEN_ENC_L_P)+(SH_R_EDG) \quad \text{Equation 8'}$$

In the above description, the media sensor 69 is mounted on the print head 10 and the print head 10 is mounted on the carriage 11 so that a fixed amount of distance is defined between the media sensor 68 and the carriage 11 in the widthwise direction of the sheet of paper P (carriage moving direction). However, the media sensor 68 may not be mounted on the print head 10 or the carriage 11 if the media sensor 68 can move together with the carriage 11 while maintaining fixed the distance between the media sensor 68 and the carriage 11 (print head 10) in the sheet-widthwise direction.

What is claimed is:

1. An image-forming device comprising:

a recording medium conveying unit that conveys a recording medium in a conveying direction, the recording medium having a first medium edge and a second medium edge in a widthwise direction orthogonal to the conveying direction;

a carriage having a print head that prints on the recording medium;

a detecting unit that performs a detecting operation;

a driving unit driving the carriage and the detecting unit to move in the widthwise direction while maintaining fixed a distance between the detecting unit and the carriage in the widthwise direction;

a carriage position detecting unit that detects a position of the carriage in the widthwise direction;

a mark printing unit that controls the print head to print on the recording medium a calibrating mark, the calibrating mark having a first mark edge and a second mark edge in the widthwise direction, the print head printing the first mark edge when the carriage is located on a first-mark-edge printing carriage position and printing the second mark edge when the carriage is located on a second-mark-edge printing carriage position, the first mark edge corresponding to the first medium edge and the second mark edge corresponding to the second medium edge;

a mark-edge-detection control unit that controls the driving unit to move the carriage and the detecting unit in the widthwise direction and controls the detecting unit to detect the first mark edge and the second mark edge, the mark-edge-detection control unit controlling the carriage position detecting unit to detect a position of the carriage when the detecting unit detects the first mark edge and when the detecting unit detects the second mark edge;

an offset setting unit that sets a first edge distance offset based on a first difference between the first-mark-edge printing carriage position and a position of the carriage that is detected when the detecting unit detects the first mark edge, and that sets a second edge distance offset based on a second difference between the second-mark-edge printing carriage position and a position of the carriage that is detected when the detecting unit detects the second mark edge;

a medium-edge-detection control unit that controls the driving unit to move the carriage and the detecting unit in the widthwise direction and controls the detecting unit to detect the first medium edge and the second medium edge, the medium-edge-detection control unit controlling the carriage position detecting unit to detect a position of the carriage when the detecting unit detects the first medium edge and when the detecting unit detects the second medium edge;

an edge position determining unit that determines a first medium edge carriage position based on a position of the carriage detected when the detecting unit detects the first medium edge and the first edge distance offset, and that determines a second medium edge carriage position based on a position of the carriage detected when the detecting unit detects the second medium edge and the second edge distance offset; and a print controlling unit that controls the print head to perform printing operations on the recording medium within a printable area that is defined between the first medium edge carriage position and the second medium edge carriage position, the carriage being located at the first medium edge when the carriage position detecting unit detects that the carriage is located at the first medium edge carriage position, the carriage being located at the second medium edge when the carriage position detecting unit detects that the carriage is located at the second medium edge carriage position.

2. An image-forming device according to claim 1, wherein the detecting unit outputs a first-medium-edge detection result when detecting the first medium edge while moving in the widthwise direction, the detecting unit outputting a detection result that corresponds to the first-medium-edge detection result when detecting the first mark edge while moving in the widthwise direction, and wherein the detecting unit outputs a second-medium-edge detection result when detecting the second medium edge while moving in the widthwise direction, the detecting unit producing a detection result that corresponds to the second-medium-edge detection result when detecting the second mark edge while moving in the widthwise direction.

3. An image-forming device according to claim 2, wherein the detecting unit comprises a reflection-type optical sensor whose sensor output depends on a reflectance of a target detection area defined by the reflection-type optical sensor, the target detection area moving in the widthwise direction when the reflection-type optical sensor moves in the widthwise direction, the reflection-type optical sensor detecting each of the first and second medium edges and the first and second mark edges based on change in the sensor output that is obtained while the reflection-type optical sensor is moving in the widthwise direction.

4. An image-forming device according to claim 3, wherein the reflection-type optical sensor detects the first medium edge and the first mark edge when the sensor output changes in either one of a decreasing pattern and an increasing pattern, and wherein the reflection-type optical sensor detects the second medium edge and the second mark edge when the sensor output changes in the other one of the decreasing pattern and the increasing pattern.

5. An image-forming device according to claim 3, further comprising a reflecting member disposed in opposition to the reflection-type optical sensor within a conveying region through which the recording medium conveying unit conveys the recording medium and having a reflectance different from that of the recording medium, the target detection area being located on at least one of the reflecting member and the recording medium; and the mark printing unit controls the print head to print the calibrating mark having a reflectance substantially equal to that of the reflecting member.

6. An image-forming device according to claim 5, wherein the reflecting member has a color different from that of the recording medium; and the mark printing unit prints the calibrating mark on the recording medium in a color substantially identical to the color of the reflecting member.

7. An image-forming device according to claim 6, wherein each of the reflecting member and the calibrating mark is black in color.

8. An image-forming device according to claim 2, wherein the offset setting unit includes:

a difference determining unit that determines a value of the first difference for the first mark edge and a value of the second difference for the second mark edge at a plurality of different locations on the calibrating mark in the conveying direction; and an offset determining unit that determines, as the first edge distance offset, an average value of the values of the first difference determined at the plurality of different locations, and that determines, as the second edge distance offset, an average of the values of the second difference determined at the plurality of different locations.

9. An image-forming device according to claim 2, wherein a positional relationship of the first mark edge and the second mark edge in the widthwise direction is opposite to a positional relationship of the first medium edge and the second medium edge in the widthwise direction.

10. An image-forming device according to claim 9, wherein the mark-edge-detection control unit controls the carriage and the detecting unit to move in a right-to-left direction along the widthwise direction, wherein the medium-edge-detection control unit controls the carriage and the detecting unit to move in the right-to-left direction along the widthwise direction, wherein the first medium edge and the second medium edge are right and left edges of the recording medium, respectively, and wherein the first mark edge and the second mark edge are left and right edges of the calibrating mark, respectively.

11. An image-forming device according to claim 2, wherein the mark printing unit controls the print head to print a first calibrating mark having the first mark edge and a second calibrating mark having the second mark edge.

12. An image-forming device according to claim 11, wherein the offset setting unit includes;

a first difference determining unit that determines a value of the first difference for the first mark edge of the first calibrating mark at a plurality of different locations in the conveying direction;

a second difference determining unit that determines a value of the second difference for the second mark edge of the second calibrating mark at a plurality of different locations in the conveying direction; and an offset determining unit that determines, as the first edge distance offset, an average of the values of the first difference determined at the plurality of different locations, and that determines, as the second edge distance offset, an average of the values of the second difference determined at the plurality of different locations.

13. An image-forming device according to claim 11, wherein the mark printing unit controls the print head to print the first mark edge of the first calibrating mark and the second mark edge of the second calibrating mark substantially at the same location in the widthwise direction on the recording medium.

14. An image-forming device comprising:

a recording medium conveying unit that conveys a recording medium in a conveying direction;

a carriage having a print head that prints on the recording medium and having a detecting unit that performs a detecting operation, the print head and the detecting unit being distant from each other in a widthwise direction orthogonal to the conveying direction;

a driving unit driving the carriage to move in the widthwise direction;

a carriage position detecting unit that detects a position of the carriage in the widthwise direction;

a first recording-medium convey control unit controlling the recording medium conveying unit to convey a first recording-medium in the conveying direction;

a mark printing unit that controls the print head to print on the recording medium a calibrating mark, the calibrating mark having a first mark edge and a second mark edge in the widthwise direction, the print head printing the first mark edge when the carriage is located on a first-mark-edge printing carriage position and printing the second mark edge when the carriage is located on a second-mark-edge printing carriage position;

a mark-edge-detection control unit that controls the driving unit to move the carriage in the widthwise direction and controls the detecting unit to detect the first mark edge and the second mark edge, the detecting unit outputting a first-mark-edge detection result when detecting the first mark edge while moving in the widthwise direction and outputting a second-mark-edge detection result when detecting the second mark edge while moving in the widthwise direction, the mark-edge-detection control unit controlling the carriage position detecting unit to detect a position of the carriage when the detecting unit detects the first mark edge and when the detecting unit detects the second mark edge;

an offset setting unit that sets a first edge distance offset based on a first difference between the first-mark-edge printing carriage position and a position of the carriage that is detected when the detecting unit detects the first mark edge, and that sets a second edge distance offset based on a second difference between the second-mark-edge printing carriage position and a position of the carriage that is detected when the detecting unit detects the second mark edge;

a second recording-medium convey control unit controlling the recording medium conveying unit to convey a second recording-medium in the conveying direction, the second recording medium having a first medium edge and a second medium edge in the widthwise direction;

a medium-edge-detection control unit that controls the driving unit to move the carriage in the widthwise direction and controls the detecting unit to detect the first medium edge and the second medium edge, the detecting unit outputting a detection result that corresponds to the first-mark-edge detection result when detecting the first medium edge while moving in the widthwise direction and outputting a detection result that corresponds to the second-mark-edge detection result when detecting the second medium edge while moving in the widthwise direction, the medium-edge-detection control unit controlling the carriage position detecting unit to detect a position of the carriage when the detecting unit detects the first medium edge and when the detecting unit detects the second medium edge;

an edge position determining unit that determines a first medium edge carriage position based on a position of the carriage detected when the detecting unit detects the first medium edge and the first edge distance offset, and that determines a second medium edge carriage position based on a position of the carriage detected when the detecting unit detects the second medium edge and the second edge distance offset; and a print controlling unit that controls the print head to perform printing operations on the second recording medium within a printable area that is defined between the first medium edge carriage position and the second medium edge carriage position, the carriage being located at the first medium edge when the carriage position detecting unit detects that the carriage is located at the first medium edge carriage position, the carriage being located at the second medium edge when the carriage position detecting unit detects that the carriage is located at the second medium edge carriage position.

* * * * *